US006038423A

United States Patent [19]

Tagawa et al.

[11] Patent Number: 6,038,423

[45] Date of Patent: Mar. 14, 2000

[54] IMAGE FORMATION SYSTEM INCLUDING AN INTERMEDIATE TRANSFER BELT AND METHOD FOR SENSING AND CORRECTING SPEED AND POSITION VARIATIONS OF THE BELT

[75] Inventors: Kozo Tagawa; Yoshiki Matsuzaki; Takeshi Kato; Tsutomu Udaka; Junichi Murakami; Susumu Kibayashi, all of Ebina, Japan

[73] Assignee: Fuji Xerox Co., Ltd., Tokyo, Japan

[21] Appl. No.: 08/959,118

[22] Filed: Oct. 28, 1997

[30] Foreign Application Priority Data

Oct. 28, 1996 [JP] Japan ..... 8-285103
Jul. 23, 1997 [JP] Japan ..... 9-196612

[51] Int. Cl.[7] ..... G03G 15/00; G03G 21/00

[52] U.S. Cl. ..... 399/301; 399/162; 399/302

[58] Field of Search ..... 399/49, 301, 302, 399/308, 162

[56] References Cited

U.S. PATENT DOCUMENTS 5,287,162 2/1994 de Jong et al. ..... 399/49
5,457,518 10/1995 Ashikaga et al. ..... 399/28
5,579,092 11/1996 Isobe et al. ..... 399/49 X
5,881,346 3/1999 Mori et al. ..... 399/301

FOREIGN PATENT DOCUMENTS 4-172376 6/1992 Japan .
4-234064 8/1992 Japan .
6-130871 5/1994 Japan .
6-225096 8/1994 Japan .
6-253151 9/1994 Japan .

*Primary Examiner*—Fred L Braun
*Attorney, Agent, or Firm*—Oliff & Berridge, PLC

[57] ABSTRACT

A registration pattern is formed on an intermediate transfer belt by using one photosensitive body. Pattern parts transferred onto the intermediate transfer belt vary in spacing due to speed variation occurring at the transfer time. The passing timing of the registration pattern is read through a read section placed downstream from the photosensitive body and speed (position) variation is sensed. The sense data is gotten over several cycles of the intermediate transfer belt and a low-frequency component caused by thickness unevenness of the intermediate transfer belt is extracted. The extracted data is subjected to the effects of variations at both the formation time and read time of the registration pattern and thus is corrected of calculating true speed (position) variation data. For example, a drive roll is controlled based on the data and an image is formed.

15 Claims, 19 Drawing Sheets

IMAGE FORMATION SYSTEM INCLUDING AN INTERMEDIATE TRANSFER BELT AND METHOD FOR SENSING AND CORRECTING SPEED AND POSITION VARIATIONS OF THE BELT

BACKGROUND OF THE INVENTION

1. Field of the Invention

This invention relates to an image formation system for forming multicolor images.

2. Description of the Related Art

FIG. 16 is a schematic block diagram to show an example of a conventional image formation system. In the figure, numeral 1 is an image reader, numeral 2 is an image writer, numeral 3 is a photosensitive body, numeral 4 is a developing machine, numeral 5 is a transfer device, numeral 6 is a cleaner, numeral 7 is an intermediate transfer belt, numeral 8 is a drive roll, numeral 9 is a cleaner, numeral 10 is paper, numeral 11 is a fuser, numeral 12 is a transfer roll, and numeral 13 is a control section. In the example, four image formation sections each consisting of the image writer 2, the photosensitive body 3, the developing machine 4, the transfer device 5, and the cleaner 6 are provided for forming images of different colors on the intermediate transfer belt 7, for example, forming color images of Y (yellow), M (magenta), C (cyan), and K (black). The control section 13 controls the components for forming images as described below.

A color image read through the image reader 1 or supplied from an external system is supplied to the image formation sections corresponding to the colors. In each image formation section, the image writer 2 forms a latent image on the photosensitive body 3, the developing machine deposits the corresponding color toner on the photosensitive body 3 for development, and the transfer device 5 transfers the image to the intermediate transfer belt 7. Unnecessary toner is collected in the cleaner 6.

The color images formed in the image formation sections are thus formed on the intermediate transfer belt 7 in overlapped relation. The color images transferred to the intermediate transfer belt 7 are transferred to paper 10 by means of the transfer roll 12 and fused on the paper by the fuser 11. A final color image is thus formed on the paper 10.

Unnecessary toner on the intermediate transfer belt 7 is collected in the cleaner 9.

The intermediate transfer belt 7 is turned by the drive roll 8. Thus, if the speed of the intermediate transfer belt 7 varies, the formation positions of color images become different, causing a color shift, inconsistencies in density, etc. The transport speed of the intermediate transfer belt 7 is represented by product of angular velocity of the drive roll 8 and distance L between the rotation center of the drive roll 8 and the intermediate transfer belt 7. Possible causes of a color shift and inconsistencies in density are variation in the angular velocity caused by eccentricity of the drive roll 8 and variation in the distance L between the rotation center of the drive roll 8 and the intermediate transfer belt 7.

FIG. 17 is an illustration of speed variation of the intermediate transfer belt 7, wherein the radius of the drive roll 8 is r, the thickness of the intermediate transfer belt 7 is D0, and the transport speed of the intermediate transfer belt 7 is Vb. The distance L between the rotation center of the drive roll 8 and the intermediate transfer belt 7 is the radius r of the drive roll 8 plus a half of the thickness D0 of the intermediate transfer belt 7 (r+D0/2). As described above, the transport speed Vb of the intermediate transfer belt 7 is $$Vb=L\cdot\omega=(r+D0/2)\cdot\omega$$

If the drive roll 8 is eccentric by δr, $$Vb=L\cdot\omega=(r+\delta r+D0/2)\cdot\omega$$

Therefore, transport speed difference ΔVb is $$\Delta Vb=\delta r\cdot\omega$$

Hitherto, eccentricity of the drive roll 8 has been thought of as causes of a color shift and inconsistencies in density. For example, image formation section spacing is set to the move distance of intermediate transfer belt 7 as much as n revolutions of drive roll 8 and all color images are formed in synchronization with the speed variation caused by eccentricity of the drive roll 8 for preventing a color shift, inconsistencies in density, etc., as described in Japanese Patent Laid-Open No. Hei 4-172376. In fact, however, if images are formed in synchronization with the eccentricity of the drive roll 8, a color shift and inconsistencies in density occur. For such a color shift and inconsistencies in density, sinusoidal variation occurs over one cycle of the intermediate transfer belt 7, for example. Such variation is caused by unevenness in thickness of the intermediate transfer belt 7. For example, if the intermediate transfer belt 7 is made of a seamless belt, the unevenness in thickness occurs due to the belt manufacturing method.

Assuming that the change amount in the thickness of the intermediate transfer belt 7 is δD, $$Vb=L\cdot\omega=(r+(D0+\delta D)/2)\cdot\omega$$

$$\Delta Vb=(\delta D/2)\cdot\omega$$

from the above-described expressions, and transport speed difference ΔVb occurs. Thus, if the intermediate transfer belt 7 contains unevenness in thickness, speed variation also occurs. This speed variation becomes longer-term variation than the speed variation caused by the eccentricity of the drive roll 8.

FIGS. 18A and 18B are illustrations of a color shift caused by speed variation of the intermediate transfer belt 7 in the conventional image formation system. The graphs shown in FIGS. 18A and 18B show position shift amounts from the normal position within the time of one cycle of the intermediate transfer belt 7 and, for example, indicate that the transport speed becomes fast in the rising portion and slows down in the falling portion. As shown in FIG. 18A, color images are formed in sequence with transport of the intermediate transfer belt 7. First, a K (black) image is formed and the K (black) image formation portion is transported to the subsequent Y (yellow) image formation section for superposing a Y (yellow) image on the K (black) image. Likewise, M (magenta) and C (cyan) images are also formed in time sequence indicated by the arrows in FIG. 18A and are superposed.

FIG. 18B shows position shift amounts in the formation ranges of the color images, wherein the K (black) position shift amount is indicated by a solid line, the Y (yellow) position shift amount is indicated by a dotted line, the M (magenta) position shift amount is indicated by a dashed line, and the C (cyan) position shift amount is indicated by a dot-dash line. For example, if image position shift when the M (magenta) image is formed is assumed to be plus above 0 and minus below 0, it belongs to the minus side almost throughout the zone. However, when the C (cyan) image is formed, the transport speed of the intermediate transfer belt 7 becomes fast and the position shift belongs to the minus side in the beginning portion of the image and the plus side in the last portion of the image. Since the position shift amount varies from one color to another as shown in FIG. 18B, a color shift occurs.

FIG. 19 is a schematic block diagram to show another example of a conventional electrophotographic printer. Parts similar to those previously described with reference to FIG. 16 are denoted by the same reference numerals in FIG. 19. In the example, only one image formation section is provided and while color of toner deposited on a photosensitive body 3 by a developing machine 4 is changed, color images are formed. For example, first a K (black) image is formed on the photosensitive body 3, is transferred to an intermediate transfer belt 7, and is formed on paper 10. Then, the toner of the developing machine 4 is changed and a Y (yellow) image is formed. Subsequently, M (magenta) and C (cyan) images are formed in a similar manner.

FIGS. 20A and 20B are illustrations of a color shift caused by speed variation of intermediate transfer belt 7 in another example of a conventional electrophotographic printer. In the configuration, an image is formed on the intermediate transfer belt 7 for each color. At this time, generally the intermediate transfer belt 7 is designed to make one revolution for each color. Thus, if the speed of the intermediate transfer belt 7 varies as shown in FIG. 20A, the position shift amounts of the colors are synchronized with each other as shown in FIG. 20B; although partial shrinkage or extension exists on the actually formed image, a color shift, inconsistencies in density, or the like does not occur. In the example, the length of the intermediate transfer belt 7 corresponds to the image length, thus the time axis of the graph shown in FIG. 20A differs from the time axis scale shown in FIG. 18A.

In such a configuration, the length of the intermediate transfer belt 7 must be limited to the maximum length of an image or 1/n of the maximum length or image formation must always be started at a predetermined position. If the intermediate transfer belt 7 is set to any desired length and image formation is started at any desired position, a color shift occurs as in the configuration shown in FIG. 16.

In the examples, an image is once formed on the intermediate transfer belt 7 and is transferred to paper. If paper is transported on a belt and an image is transferred from a photosensitive body directly to the paper, a color shift and inconsistencies in density are also caused by unevenness in the belt transport speed.

Some techniques are designed for sensing speed variation and position variation of the intermediate transfer belt 7 and the transport belt and correcting the image formation position. For example, sense means are described in Japanese Patent Laid-Open Nos. Hei 4-172376, 4-234064, etc., wherein an encoder is attached to a roll shaft driven by a belt and the belt speed is sensed from the angular velocity.

FIGS. 21 and 22 are illustrations of examples of conventional speed variation sense means. In the figures, numeral 41 is a belt, numeral 42 is an encoding roll, numeral 43 is a bearing, numeral 44 is an encoder, and numeral 45 is a pinch roll. The encoding roll 42 is rotated with transport of the belt 41 and the encoder 44 is rotated via the bearing 43, then the rotation speed is detected.

However, in the configuration in which the belt 41 is placed on the encoding roll 42 as shown in FIG. 21, the portion of the encoding roll 42 is also affected by unevenness in thickness of the belt 41, eccentricity of the encoding roll 42 itself, etc., and speed variation caused by the unevenness in thickness of the belt 41 cannot accurately be measured. In the system in which the pinch roll 45 presses the belt 41 against the encoding roll 42 and the encoding roll 42 is rotated as shown in FIG. 22, the belt 41, which is sandwiched between the two rolls, is easily subjected to damage and reliability is not ensured.

FIG. 23 is an illustration of another example of conventional speed variation sense means. In the figure, numeral 46 is a mark and numeral 47 is a sensor. For example, as described in Japanese Patent Laid-Open No. Hei 6-130871, another speed variation sense method is also available wherein marks 46 are previously printed on a belt 41 and are sensed by sensor 47, whereby the speed of the belt 41 is sensed. However, it is difficult to print the marks 46 accurately, thus the method involves a problem in precision.

On the other hand, so-called registration control technique for registering the start positions, etc., of images formed by image formation sections is known, for example, as described in Japanese Patent Laid-Open No. Hei 6-253151. The registration technique described here is to form an image on a belt in each image formation section, detect the image by a sensor, and correct an image position shift in each image formation section. In the conventional registration control technique, write position variation among the image formation sections is only corrected and a color shift and inconsistencies in density in images caused by belt speed variation as described above are not corrected.

SUMMARY OF THE INVENTION

The invention has been made in view of the above circumstances, and therefore an object of the invention is to provide an image formation system that can correct variation in the transport speed or position of a belt and provide an image of good image quality from which a color shift and inconsistencies in density are removed.

To the ends, according to a first aspect of the invention, there is provided an image formation system comprising a belt, means for driving the belt, means being placed facing the belt driven by the drive means for forming an image at a predetermined timing, means being disposed at a position different from the position of the image formation means for reading the image formed by the image formation means, and means for recognizing the position or speed variation amount of the belt driven by the drive means at least based on the image read by the image read means.

In the image formation system of the invention, a plurality of image formation means may be provided facing the belt and the variation amount recognition means recognizes the variation amount based on an image formed using at least one of image formation means and the distance between the image formation means forming the image and the image read means along the belt.

In the image formation system of the invention, the image formation means for forming the image used by the variation amount recognition means may be the image formation means at the longest distance from the image read means.

In the image formation system of the invention, the image read means may be placed at a position distant by a half length of the belt from the image formation means along the belt.

According to a second aspect of the invention, there is provided an image formation system comprising a belt, means for driving the belt, means for measuring cyclic variation when the belt is driven, and means for recognizing the position or speed variation amount of the belt caused by unevenness in thickness of the belt based on the cyclic variation amount of the belt measured by the periodic variation measurement means.

In the image formation system of the invention, the periodic variation measurement means may get position information of the belt in response to the cycle of the belt.

In the image formation system of the invention, the variation amount recognition means may extract a low-frequency component from the belt position information in more than one cycle of the belt gotten by the periodic variation measurement means as the belt position or speed variation amount caused by the unevenness in thickness of the belt.

In the image formation system of the invention, the variation amount recognition means may make a phase difference correction based on the phase difference caused by the difference between a predetermined reference position and the measurement position of the periodic variation measurement means for the belt position or speed variation amount caused by the unevenness in thickness of the belt and recognize as the belt position or speed variation amount caused by the unevenness in thickness of the belt at the reference position.

The image formation system of the invention may further include drive control means for controlling the drive speed of the drive means based on the position or speed variation amount recognized by the variation amount recognition means.

The image formation system of the invention may further include means for controlling the move distance of the belt based on the position or speed variation amount recognized by the variation amount recognition means.

The image formation system of the invention may further include image formation control means for controlling the image formation position based on the position or speed variation amount recognized by the variation amount recognition means.

According to a third aspect of the invention, there is provided a control method of an image formation system comprising a belt, means for driving the belt, means being placed facing the belt driven by the drive means for forming an image, means being disposed at a position different from the position of the image formation means for reading the image formed by the image formation means, and control means, the control method comprising the steps of driving the belt by the drive means, forming a pattern on the belt by the image formation means at a predetermined timing, reading the pattern by the image read means, measuring a time interval, recognizing the position or speed variation amount of the belt based on the measured time interval, and performing image formation control at the image formation time based on the recognized position or speed variation amount.

In the image formation system control method of the invention, the image formation control at the image formation time may be to control drive of the drive means based on the recognized position or speed variation amount.

In the image formation system control method of the invention, the image formation control at the image formation time may be to control image formation of the image formation means based on the recognized position or speed variation amount.

In the image formation system control method of the invention, when the position or speed variation amount of the belt is recognized, a low-frequency component may be extracted from time interval data measured by the image read means as long as a plurality of cycles of the belt, amplitude and phase may be corrected, and the position or speed variation amount of the belt at a reference position may be recognized.

The above and other objects and features of the present invention will be more apparent from the following description taken in conjunction with the accompanying drawings.

DETAILED DESCRIPTION OF THE PREFERRED EMBODIMENTS

Now, a description will be given in more detail of preferred embodiments of the invention with reference to the accompanying drawings.

Figure 1:
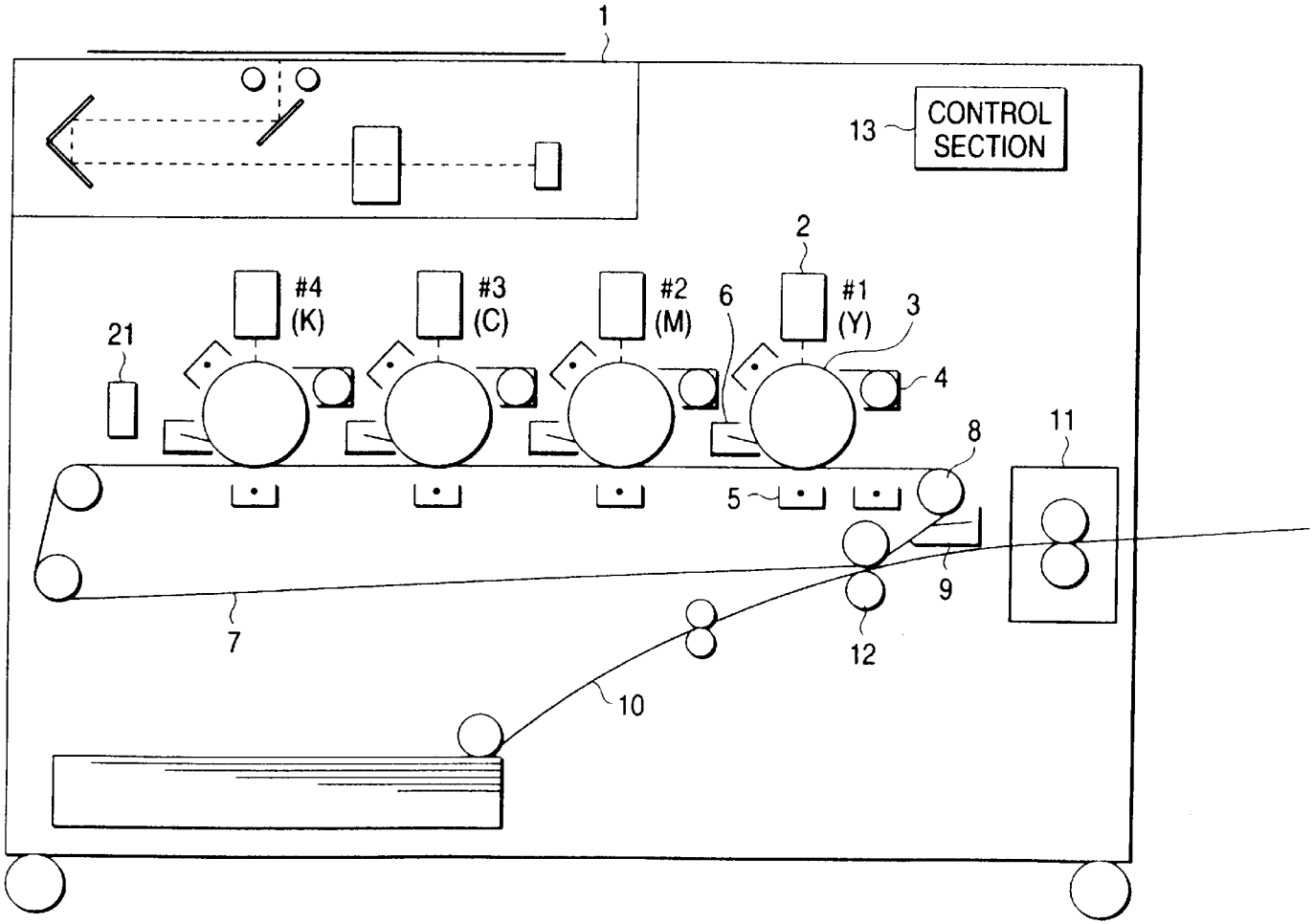
FIG. 1 is a schematic block diagram to show one embodiment of an image formation system of the invention.
Figure 2:
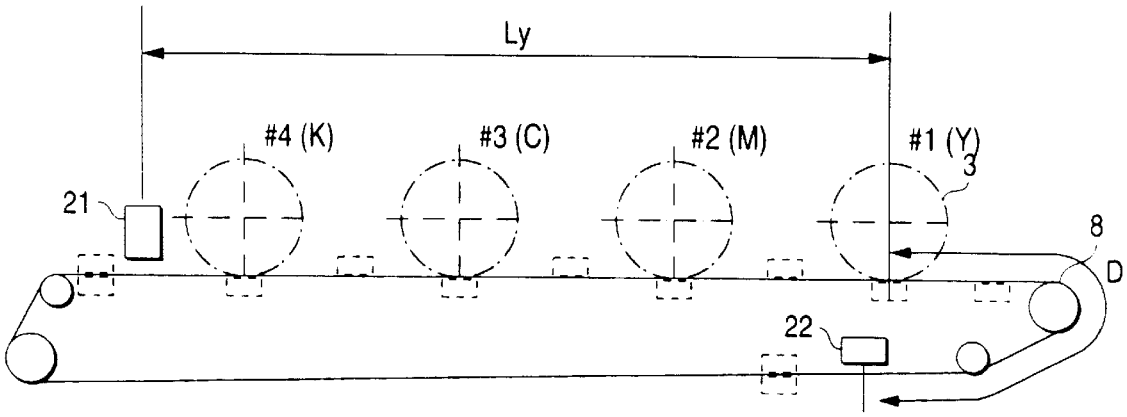
FIG. 2 is an illustration of the relationship between image formation positions and read position.
Figure 3:
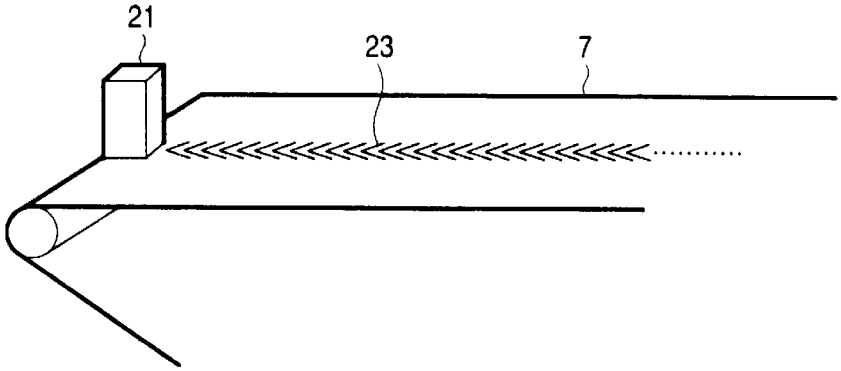
FIG. 3 is an illustration of an example of a read section and a registration pattern.
Figure 16:
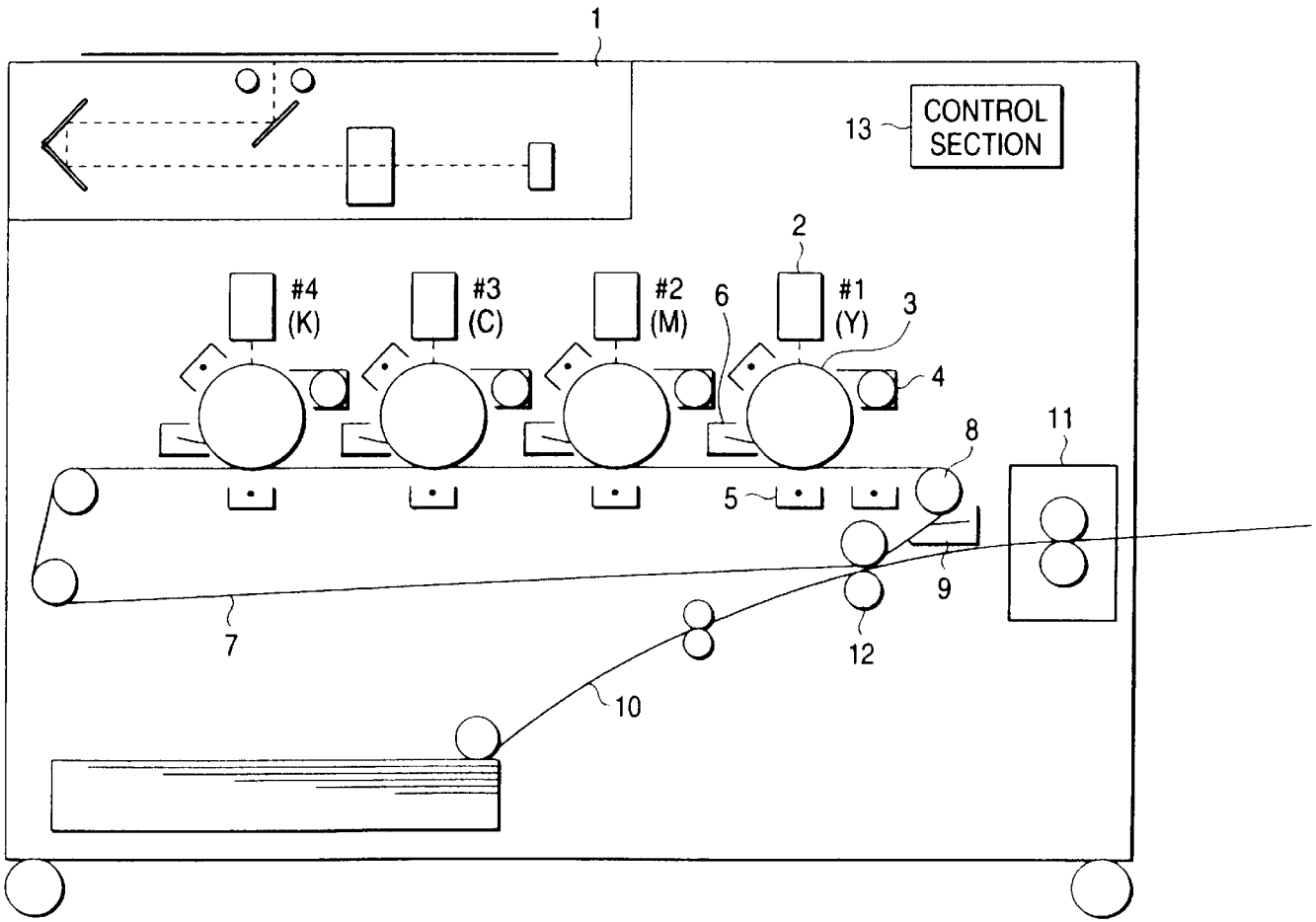
FIG. 16 RELATED ART
FIG. 16 is a schematic block diagram to show an example of a conventional image formation system.
Figure 17:
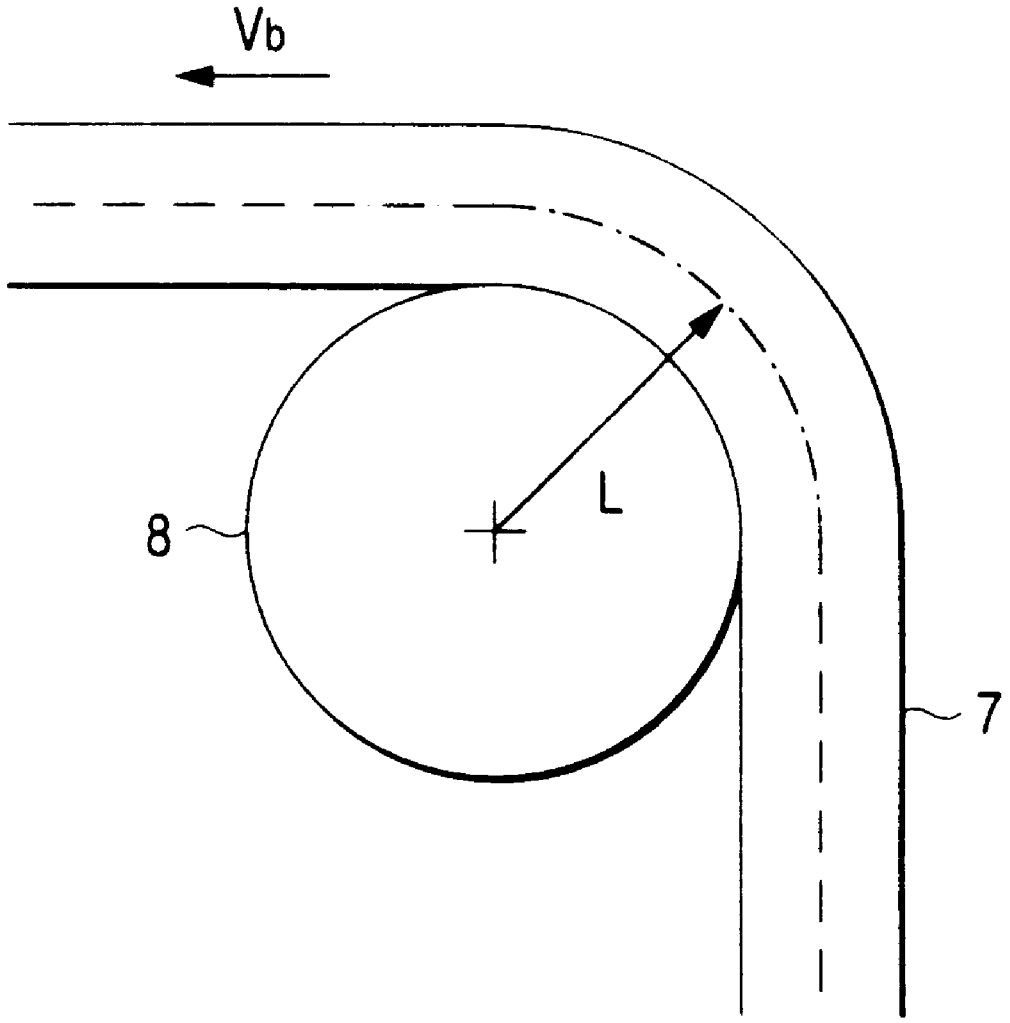
FIG. 17 is an illustration of speed variation of an intermediate transfer belt 7.
Figure 18A:
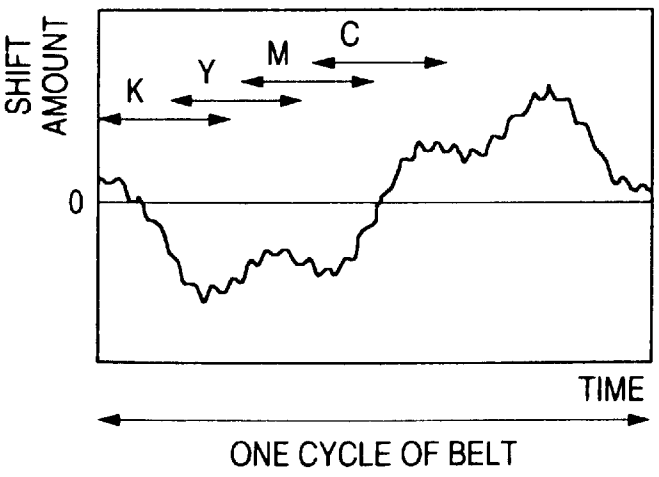
FIG. 18A RELATED ART
FIGS. 18A and 18B are illustrations of a color shift caused by speed variation of the intermediate transfer belt 7 in the conventional image formation system.
Figure 18B:
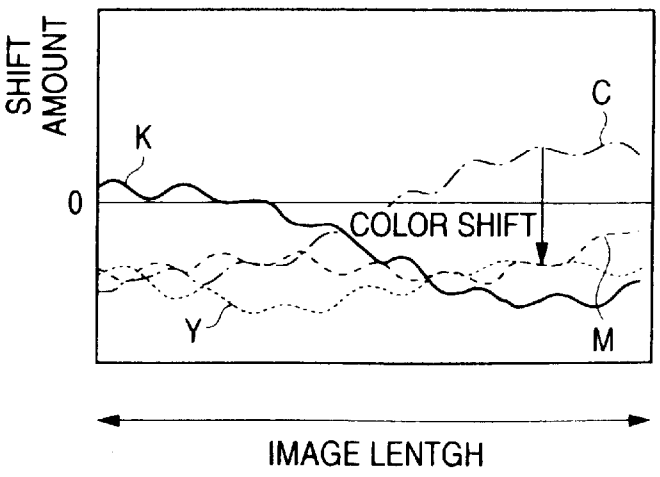
FIG. 18B RELATED ART
Figure 19:
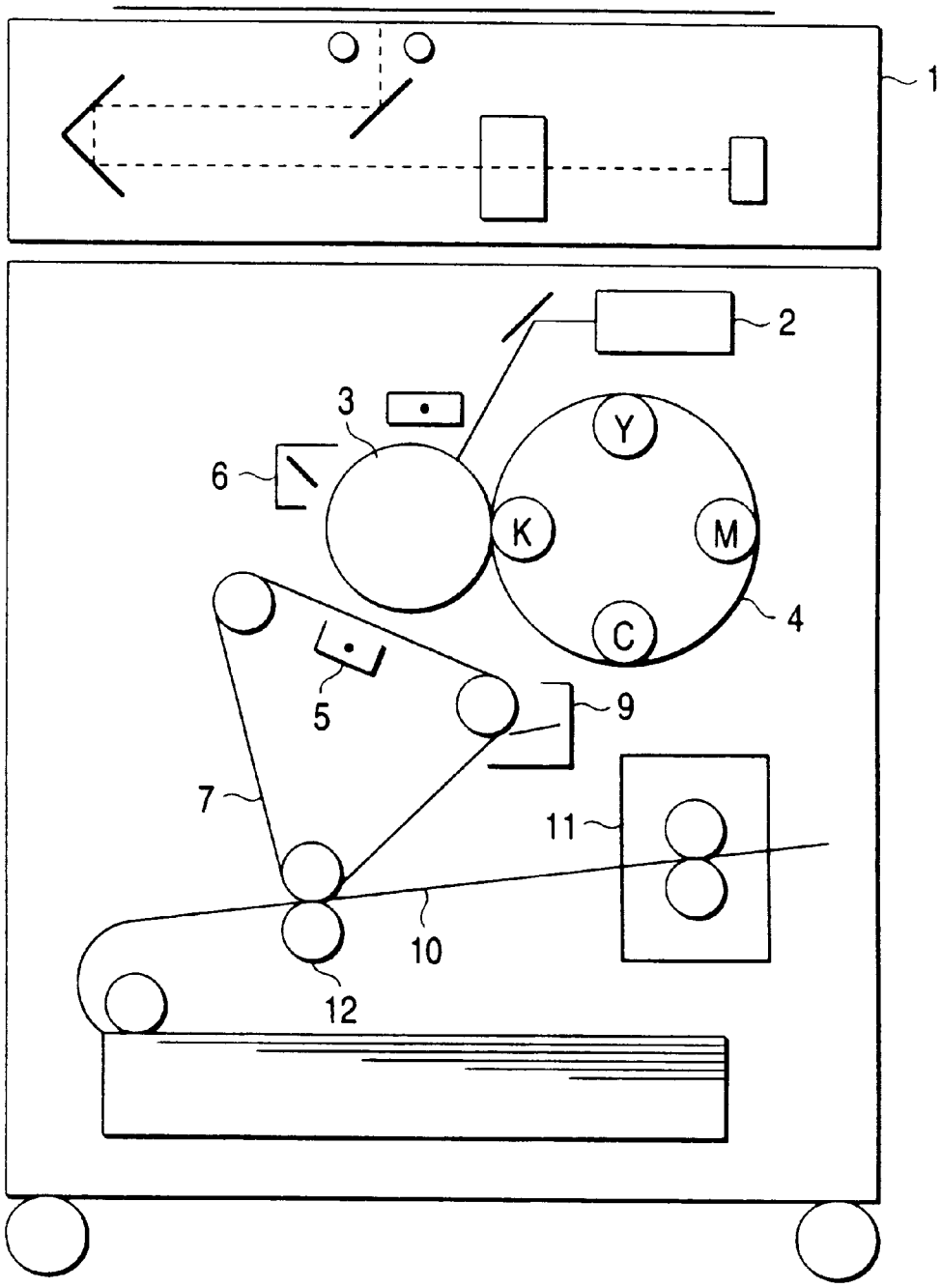
FIG. 19 RELATED ART
FIG. 19 is a schematic block diagram to show another example of a conventional electrophotographic printer.
Figure 20B:
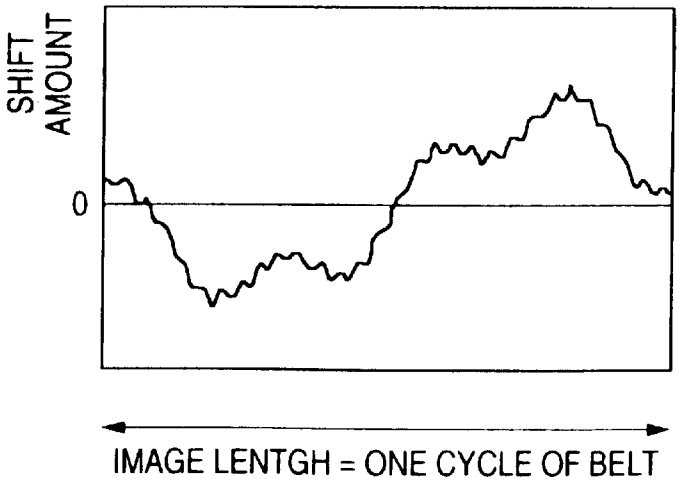
FIG. 20B RELATED ART
FIGS. 20A and 20B are illustrations of a color shift caused by speed variation of intermediate transfer belt 7 in another example of a conventional electrophotographic printer.
Figure 20A:
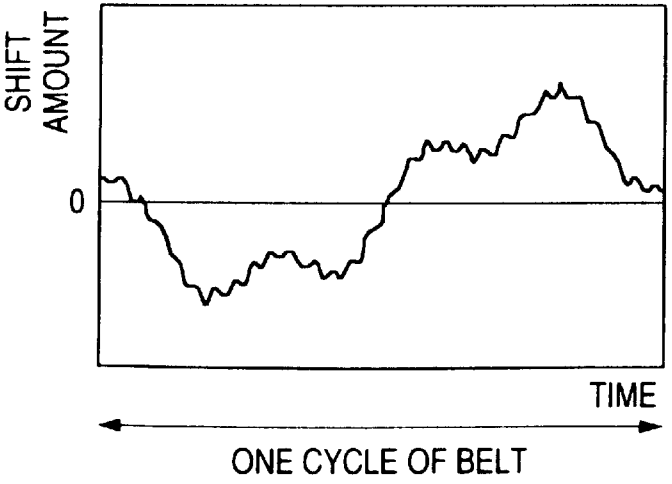
FIG. 20A RELATED ART
Figure 21:
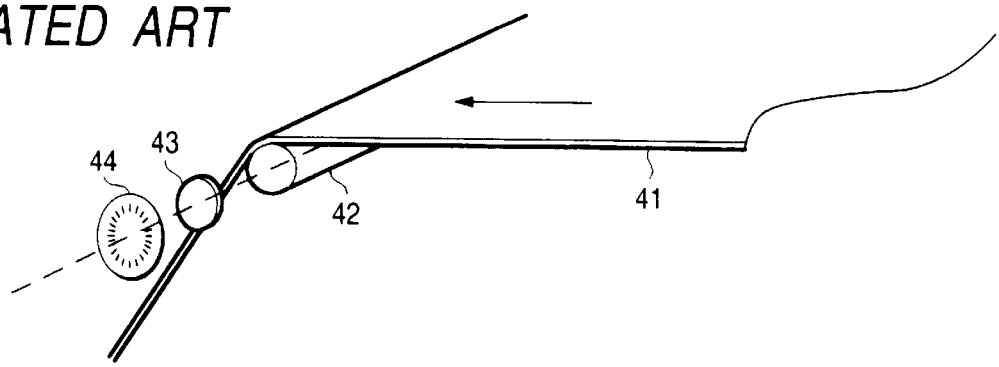
FIG. 21 RELATED ART
FIG. 21 is an illustration of an example of conventional speed variation sense means.

FIG. 1 is a schematic block diagram to show one embodiment of an image formation system of the invention. FIG. 2 is an illustration of the relationship between image formation positions and read position. FIG. 3 is an illustration of an example of a read section and a registration pattern. Parts similar to those previously described with reference to FIG. 16 are denoted by the same reference numerals in FIG. 1 and will not be discussed again. Numeral 21 is a read section, numeral 22 is a home sensor, and numeral 23 is a registration pattern. The read section 21 is disposed downstream from image formation sections on an intermediate transfer belt 7. The read section 21 reads the cyclic registration pattern 23 formed on the intermediate transfer belt 7 by one or more image formation sections, as shown in FIG. 3. The read section 21 can be made of a reflection-type photo receptor, etc., for example, Alternatively, it may use a transmission-type photo receptor if the intermediate transfer belt 7 is made of a material easily transmitting light from a light source. Further, CCD, etc., can be used as a sensor to input the registration pattern as an image and process it. A control section 13 detects speed variation or position variation caused by unevenness in thickness of the intermediate transfer belt 7 based on the read position of the registration pattern 23 read through the read section 21.

The home sensor 22 detects a marker disposed at one point of the intermediate transfer belt 7. Here, the position of the home sensor 22 is used as a reference position. Assume that the registration pattern 23 is formed by #1 photosensitive body 3 (Y) and that the distance between the home sensor 22 and the photosensitive body #1 along the intermediate transfer belt 7 is D and the distance between the #1 photosensitive body 3 and the read section 21 along the intermediate transfer belt 7 is Ly, as shown in FIG. 2. Of course, the registration pattern 23 may be formed by another photosensitive body 3. However, if 1-cycle sinusoidal unevenness exists in the thickness of the intermediate transfer belt 7, the longer the distance between the photosensitive body 3 and the read section 21 along the intermediate transfer belt 7, the larger the positional shift amount; the shift amount is easily detected. Preferably, the distance between the photosensitive body 3 for forming the registration pattern 23 and the read section 21 along the intermediate transfer belt 7 is a half of the full length of the intermediate transfer belt 7, in which case the positional shift amount is doubled and can be detected.

Figure 4:
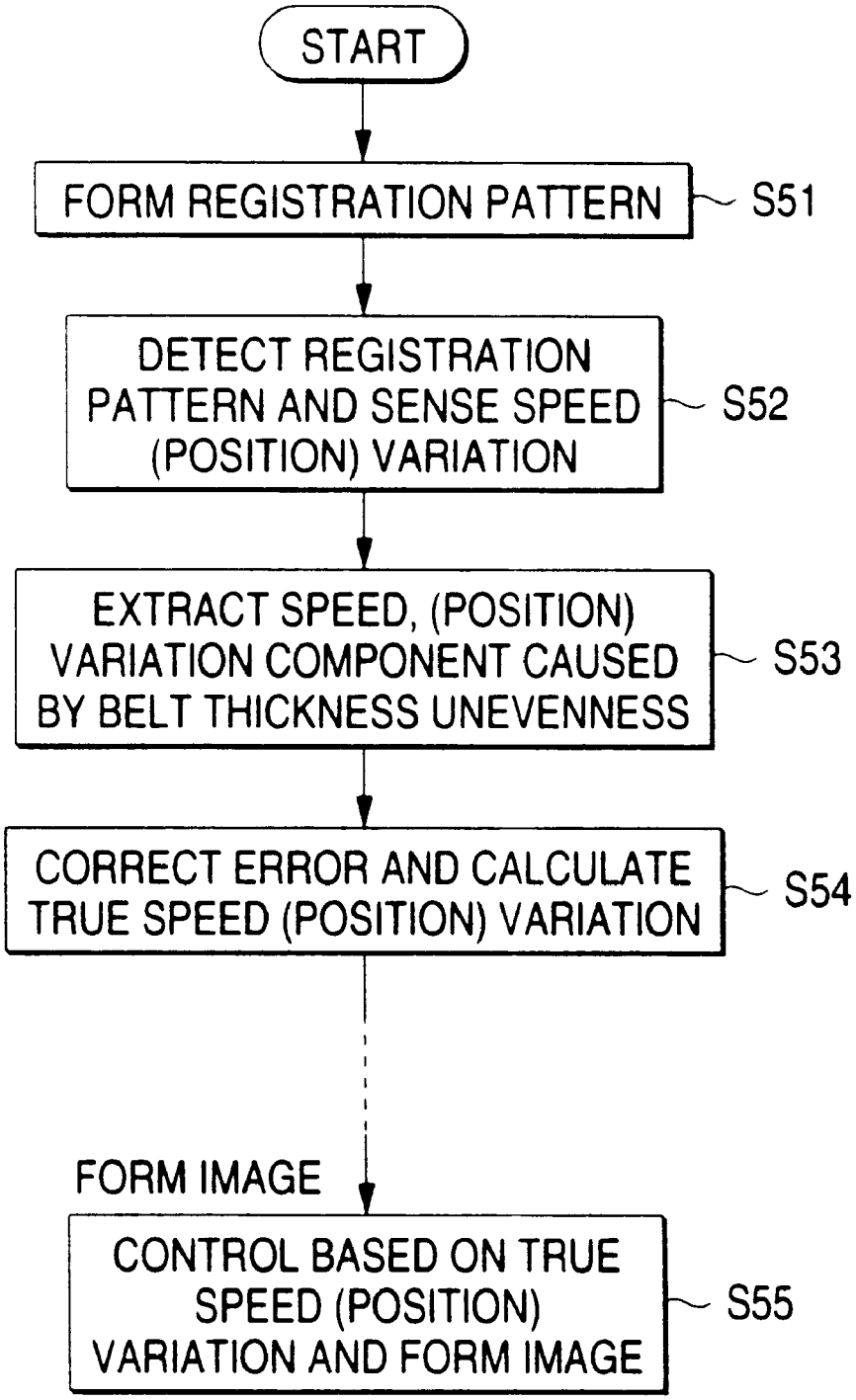
FIG. 4 is a flowchart to show an outline of the operation for correcting a color shift and inconsistencies in density in the embodiment of the image formation system of the invention.

In the configuration, when the image formation system is adjusted before shipment or the intermediate transfer belt 7 is replaced, the operation for correcting a color shift and inconsistencies in density caused by unevenness in the thickness of the intermediate transfer belt 7 is performed. FIG. 4 is a flowchart to show an outline of the operation for correcting a color shift and inconsistencies in density in the embodiment of the image formation system of the invention. First, at step S51, the registration pattern 23 is developed at given pitches on at least one of the photosensitive bodies 3 and is transferred to the turned intermediate transfer belt 7. It can be formed comparatively easily and moreover with high accuracy as compared with the case where marks are previously put on the intermediate transfer belt 7 as in the prior art. Spacing of the pattern parts transferred onto the intermediate transfer belt 7 varies due to speed variation occurring at the transfer time.

At step S52, the read section 21 placed downstream from the photosensitive bodies 3 reads the passing timing of the transferred registration pattern 23, whereby speed variation or position variation occurring at the transfer time can be sensed.

At step S53, data of the speed variation or position variation sensed at step S52 is gotten over several cycles of the intermediate transfer belt 7 and variation other than the thickness unevenness component of the intermediate transfer belt 7 is removed from all speed variation components. At this time, the variation component asynchronous with the thickness unevenness of the intermediate transfer belt 7 can be removed by averaging the speed or position variation data gotten in several cycles of the intermediate transfer belt 7. The variation component synchronous with the thickness unevenness of the intermediate transfer belt 7 may be averaged in the cycle of speed variation to be removed and may be subtracted from the data averaged in the cycle of the intermediate transfer belt 7.

The speed or position variation caused by the thickness unevenness of the intermediate transfer belt 7 extracted at step S53 contains an error. That is, when the registration pattern 23 is transferred to the intermediate transfer belt 7 and the pitches of the intermediate transfer belt 7 are measured at the read section 21, speed variation is also caused by the thickness unevenness of the belt. Thus, the sense result contains the speed or position variation occurring when the registration pattern 23 is sensed as a sense error in addition to the speed or position variation occurring when the registration pattern 23 is transferred. At step S54, such an error is corrected.

The sense error results from delaying the phase of the waveform of the actual speed or position variation occurring when the registration pattern 23 is transferred by the distance between the transfer point and the read section 21. Therefore, the sense result is a composite wave of two waveforms equal in amplitude and cycle and different only in phase, and only the true speed or position variation is calculated based on the phase difference. The data of the true speed or position variation calculated is stored.

At step S55, for example, the rotation speed or position of a drive roll 8 for driving the intermediate transfer belt 7 is controlled or image formation positions, etc., in the image formation sections are controlled based on the stored true speed or position variation data and a final image is formed, whereby an image of high image quality with no color shift or inconsistencies in density can be provided.

The above-described operation will be discussed in detail. In the description that follows, formation of an image of the registration pattern 23 on the intermediate transfer belt 7 with #1 photosensitive body 3 (Y) is taken as an example. The registration pattern 23 developed on the #1 photosensitive body 3 (Y) at a given timing is transferred onto the intermediate transfer belt 7 at transfer point (Y). The transferred registration pattern 23 is read through the read section 21 positioned downstream from the photosensitive bodies 3 as the intermediate transfer belt 7 is moved by rotation of the drive roll 8.

Figure 5A:
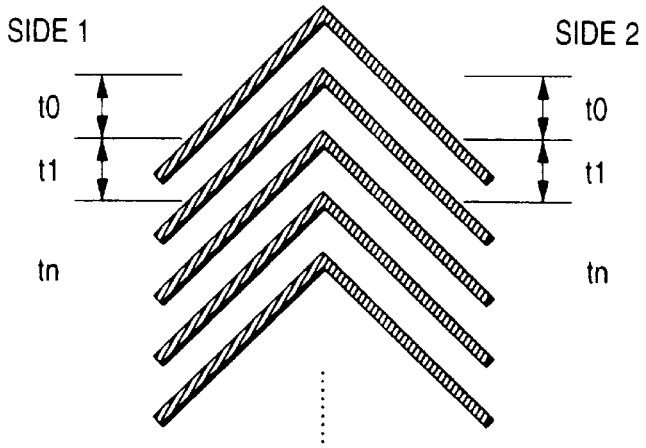
FIGS. 5A and 5B are illustrations of an example of the registration pattern.
Figure 5B:
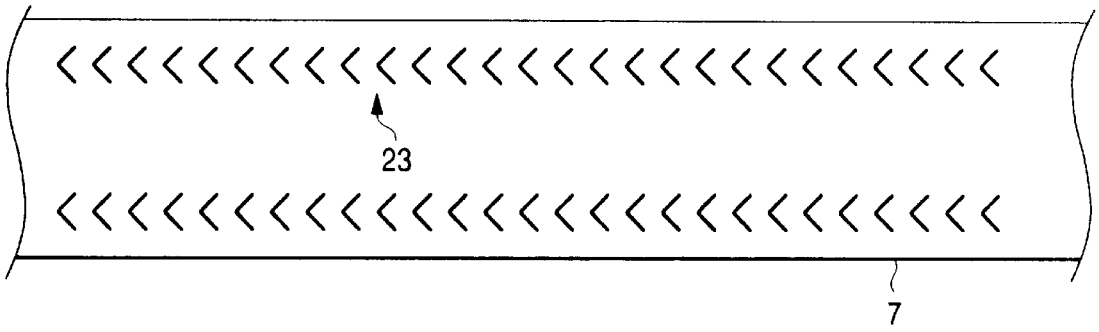

FIGS. 5A and 5B are illustrations of an example of the registration pattern. Here, a pattern of shape called a Chevron pattern as shown in FIG. 5A is used as the registration pattern 23. The read section 21 detects the passing timing of the pattern on each side shown as Side 1, Side 2 in FIG. 5A, namely, t0, t1, . . . tn. At this time, of image position shift in the nth pattern part, image position variation caused by thickness unevenness of the intermediate transfer belt 7 or eccentricity of the photosensitive bodies 3, the drive roll 8, etc., which will be hereinafter referred to as process AC position shift, ΔXn, is represented as $$\Delta Xn = V \times \Sigma^{n} \tfrac{1}{2}(tn_{side2} + tn_{side1}) - n33\ L$$

$$[L = V \times \Sigma^{N} \tfrac{1}{2}(tn_{side2} + tn_{side1})/N]$$

where V is reference speed and N is the number of pattern parts formed in one cycle of the intermediate transfer belt 7.

$(tn_{side2}+tn_{side1})/2$ when the nth part of the registration pattern 23 is detected indicates the average required time in the move direction of the intermediate transfer belt 7 between detection of the (n−1)st part of the registration pattern 23 and detection of the nth part of the registration pattern 23. For example, if the intermediate transfer belt 7 shifts in a direction perpendicular to the move direction, the required time in the move direction of the intermediate transfer belt 7 can be found without the influence of the shift by averaging on both sides of the registration pattern 23. The required time between detection of the part of the registration pattern at a predetermined reference position and detection of the nth part may be found by adding the time required for detecting the first part of the registration pattern 23, the time required for detecting the second part, . . . , and the time required for detecting the nth part together. The required time is multiplied by the reference speed, whereby the move distance when the intermediate transfer belt 7 moves for the required time at the reference speed can be found. L is the reference distance between the parts of the registration pattern 23 and the theoretical distance to the detection time of the nth part of the registration pattern 23 can be represented as n×L. The difference between the move distance and the theoretical distance is the process AC position shift ΔXn when the nth part of the registration pattern 23 is detected. The reference distance L between the parts of the registration pattern 23 is found by dividing the total measurement distance by the number of pattern parts.

One row of the registration pattern 23 can be provided at the center of the intermediate transfer belt 7 as shown in FIG. 3 or two rows can also be provided as shown in FIG. 5B. Alternatively, three rows may be provided at the center and both ends or more rows may be provided. The image formation position may be any desired position. The read section 21 may be placed corresponding to the formation position of the registration pattern 23. Particularly, more than one row of the registration pattern 23 can be used to enhance sense accuracy.

Figure 6A:
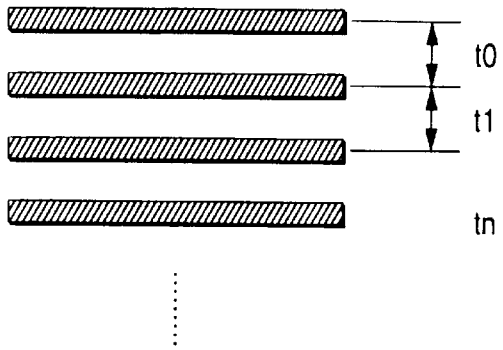
FIGS. 6A and 6B are illustrations of another example of the registration pattern.
Figure 6B:
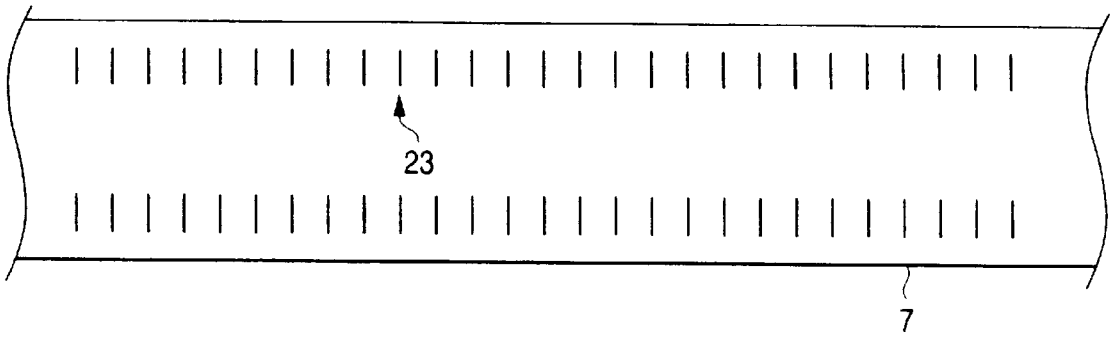

FIGS. 6A and 6B are illustrations of another example of the registration pattern. In this example, a striped registration pattern 23 made up of lines in the direction perpendicular to the move direction of the intermediate transfer belt 7 is shown. In this case, the times t0, t1, . . . taken for detecting the lines are measured in sequence. The image formation position variation is represented as $$\Delta Xn = V \times \Sigma^{n}(tn) - n \times L$$

$$[L = V \times \Sigma^{N}(tn)/N]$$

where N is the number of pattern parts printed in one cycle of the intermediate transfer belt 7. A position shift can be thus found as with the registration pattern shown in FIGS. 5A and 5B. The registration pattern 23 shown in FIGS. 6A and 6B, which has the same shape at the left and right, may be provided on both sides of the intermediate transfer belt 7, for example, as shown in FIG. 6B, and the time on both side patterns may be measured for raising accuracy. To use another pattern as the registration pattern 23, image formation position variation may be calculated in response to the pattern used.

Figure 7A:
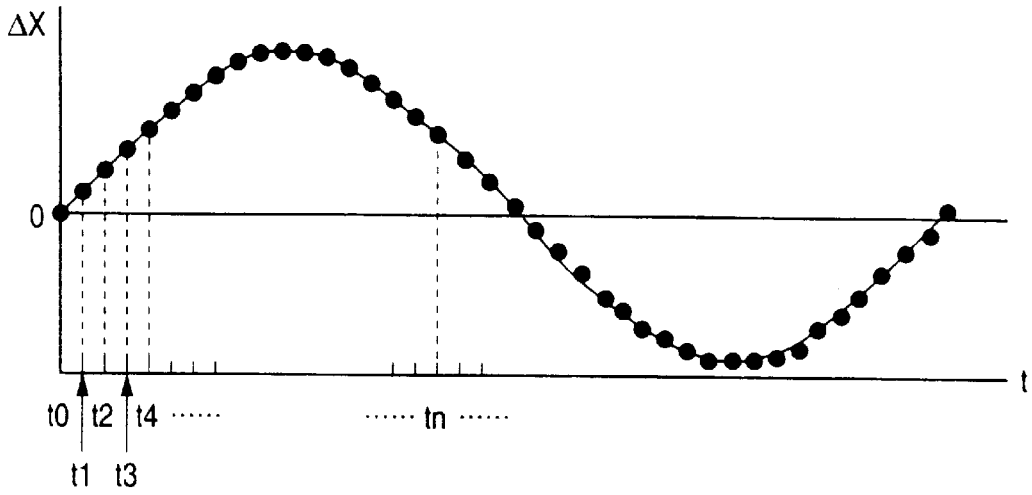
FIGS. 7A and 7B are illustrations of an example of the position shift amount found by reading the registration pattern.
Figure 7B:
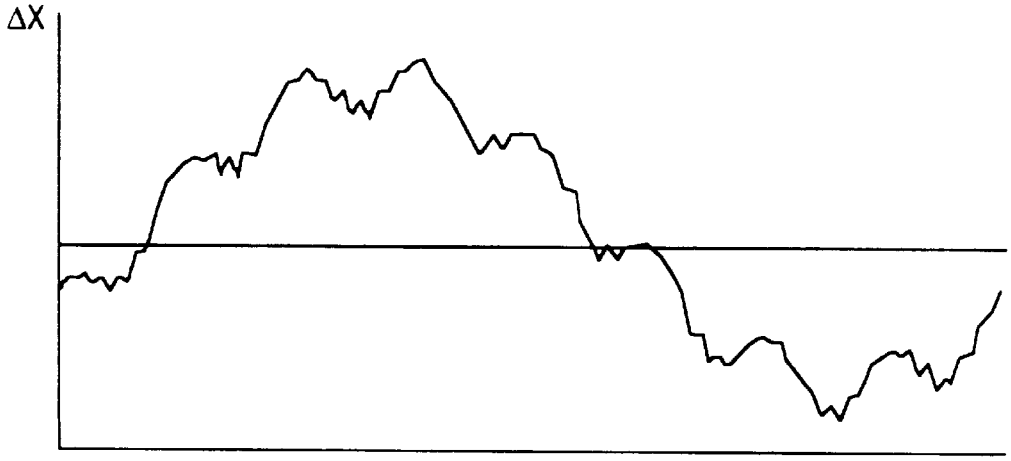

FIGS. 7A and 7B are illustrations of an example of the position shift amount found by reading the registration pattern. The registration pattern 23 is read as described above and the calculated position shift amounts are plotted with respect to the time over one cycle of the intermediate transfer belt 7. For example, if the intermediate transfer belt 7 is a seamless belt, sinusoidal thickness unevenness over one cycle exists because of the manufacturing method of the belt and the position shift amount should change like one sine wave, for example, as shown in FIG. 7A. In fact, however, a position shift is also caused by eccentricity of the photosensitive bodies 3 and the drive roll 8, and the actual detection result becomes as shown in FIG. 7B.

Figure 8:
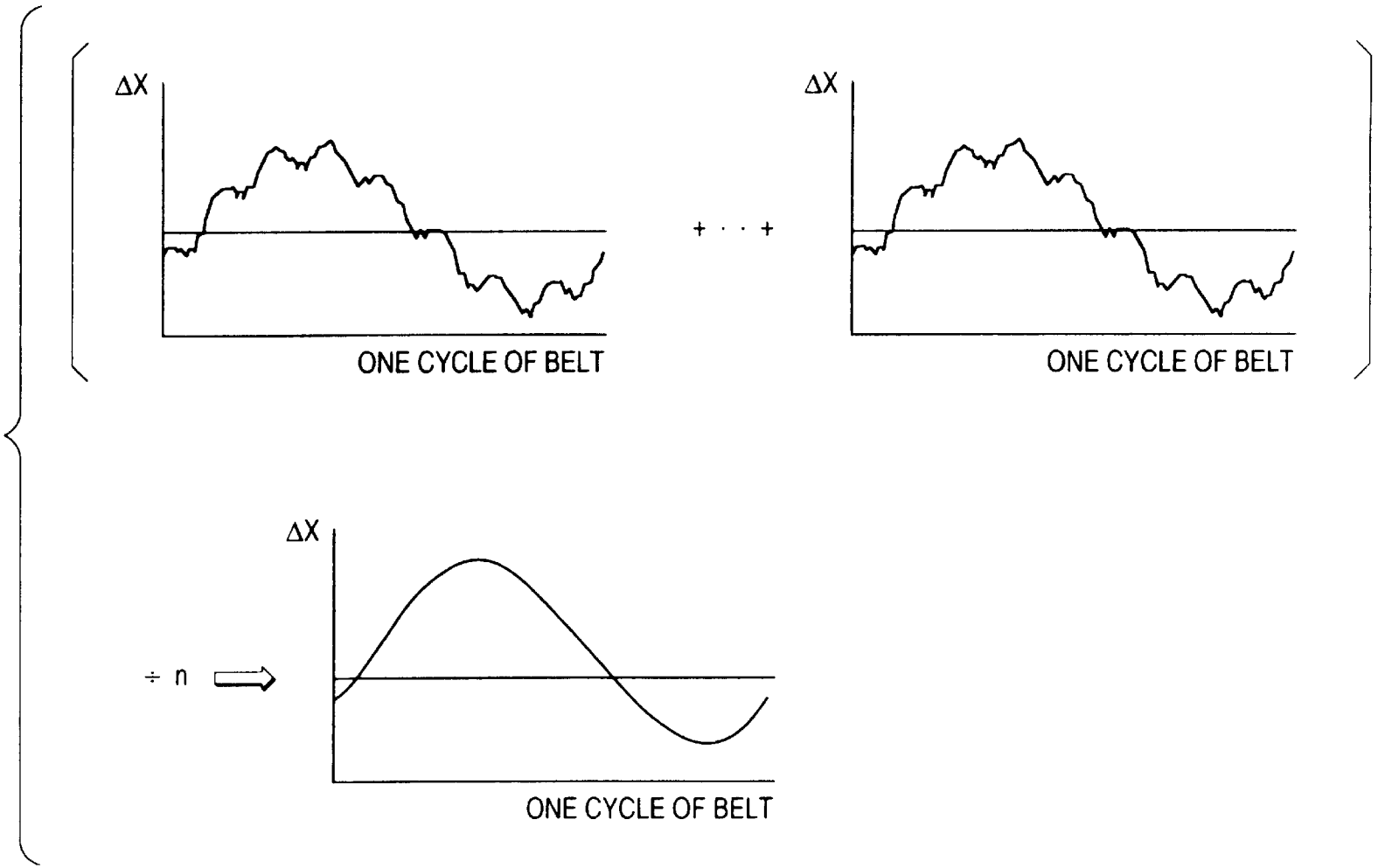
FIG. 8 is an illustration of one example of an extraction technique of a process AC position shift from position shift amount detection data.

Therefore, any other components than the position shift caused by the thickness unevenness of the intermediate transfer belt 7 need to be removed from the process AC position shift detected as described above. If the cycle of another position shift cause is asynchronous with the cycle of the thickness unevenness of the intermediate transfer belt 7, namely, one cycle of the belt, the component may be removed as follows: FIG. 8 is an illustration of one example of an extraction technique of the process AC position shift from position shift amount detection data. If the position shift component to be removed is asynchronous with the position shift caused by the thickness unevenness of the intermediate transfer belt 7, process AC position shifts are measured over N cycles of the intermediate transfer belt 7 and are separated in one cycle of the intermediate transfer belt 7 and the position shift amount at the corresponding timing is averaged, as shown in FIG. 8. For example, N position shift amounts may be added and the addition result may be divided by N. Thus, the position shift component other than the thickness unevenness of the intermediate transfer belt 7, asynchronous with one cycle of the intermediate transfer belt 7 is averaged (removed) and only the position shift component caused by the thickness unevenness indicating the same cycle appears remarkably.

If the position shift component to be removed is synchronous with the position shift caused by the thickness unevenness of the intermediate transfer belt 7, namely, if the cycle is an integer multiple, averaging is performed in the cycle of the position shift component to be removed and after extraction, subtraction may be made from the actual measurement result.

In addition to the techniques, various techniques can be used. If so-called low-pass filter processing is performed, the variation component caused by eccentricity of the photo sensitive bodies 3, the drive roll 8, etc., in a short term is removed and only the variation component caused by the thickness unevenness of the intermediate transfer belt 7 in a long term can be extracted.

Only the position shift component caused by the thickness unevenness of the intermediate transfer belt 7 can be thus extracted from the sense result of the process AC position shift. However, the result provided so far is not the true position variation data, because when the registration pattern 23 is read through the read section 21, the speed of the intermediate transfer belt 7 also varies and the position variation data provided so far is a composite of position variation caused by speed variation actually occurring at the pattern formation time and assumed position variation caused by speed variation occurring at the read time of the registration pattern 23.

Figure 9A:
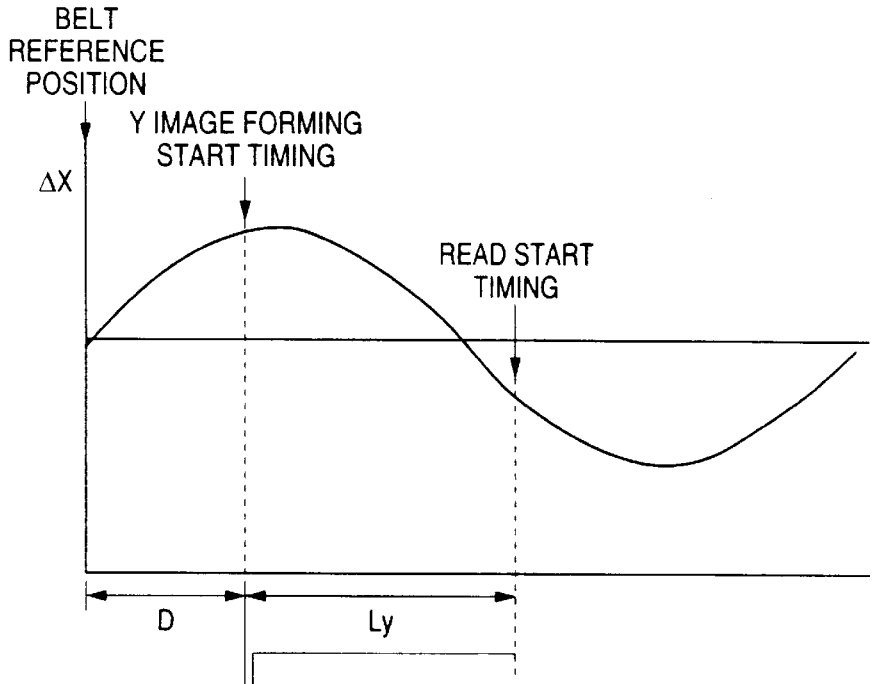
FIGS. 9A and 9B are illustrations of the relationship between actual measurement sense data and position variation (No. 1)
Figure 9B:
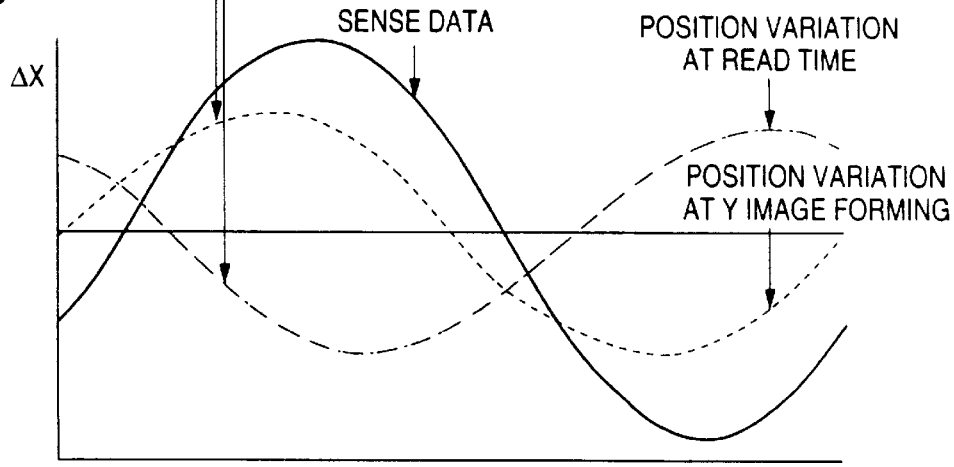

FIGS. 9A and 9B are illustrations of the relationship between actual measurement sense data and position variation. FIG. 9A shows a position variation pattern in one cycle of the intermediate transfer belt 7; the left end indicates the position shift amount at the reference position. For example, assume that the reference position is the position of the home sensor 22 in FIG. 2. Then, the time is taken by the time the intermediate transfer belt 7 moves to the position at which the #1 photosensitive body 3 forms the registration pattern 23.

Meanwhile, the position variation amount also changes. Here, the time taken for the intermediate transfer belt 7 to move from the reference position to the position of the #1 photosensitive body 3 is shown as D for convenience. Further, the time is also taken by the time the image formed on the #1 photosensitive body 3 arrives at the read position and meanwhile, the position variation amount also changes. Here, the time taken for the intermediate transfer belt 7 to move from the position of the #1 photosensitive body 3 to the position of the read section 21 is shown as Ly for convenience.

The read section 21 reads an image having a position variation pattern as indicated by a dashed line in FIG. 9B while receiving the influence of a position variation pattern as indicated by a dot-dash line. In the example shown in FIGS. 9A and 9B, the image whose position varies to the plus side is formed at the image formation time with respect to the image formation start point and is read when the position varies to the minus side. Thus, the sense data indicated by a solid line in FIG. 9B becomes the addition result of both the variation amounts. Likewise, if the image formed when the position varies to the plus side is read when the position varies to the plus side, the sensed position shift amount becomes the difference. If the image formed when the position varies to the minus side is read when the position varies to the minus side, the sensed position shift amount also becomes the difference. That is, actual measurement sense data is provided as a pattern resulting from adding the inversion pattern of the position variation pattern at the image read time to the position variation pattern at the image formation time.

Thus, the actual measurement sense data is a composite pattern of the position variation pattern at the image formation time and the inversion pattern of the position variation pattern at the image read time. If the image formation position is near to the image read position, the position variation pattern at the image formation time and the position variation pattern at the image read time become almost the same and the composite pattern of both the patterns becomes a pattern of a small amplitude. In contrast, if the image formation position is distant from the image read position, both the patterns are placed largely out of phase and the composite pattern becomes a large amplitude. Thus, preferably the position of the photosensitive body 3 for forming an image and the position of the read section 21 are distant from each other as much as possible, so that sense data of a large amplitude can be provided.

Thus, the actual measurement sense data is sensed as a composite pattern of the position shift pattern at the image formation time and the position shift pattern at the image read time. However, these two waveforms are equal in amplitude and frequency and different only in phase as much as the distance between the photosensitive body 3 and the read section 21. Thus, the true position shift caused by the thickness unevenness of the intermediate transfer belt 7 can be extracted from the actual measurement sense data according to the following procedure:

Assume that a pattern of position shift X indicated from a reference position by the intermediate transfer belt 7 is $$\Delta X = A\sin(\omega b + \phi 1)$$

At this time, position variation Xw at the image formation time of the registration pattern 23 can be represented as $$\Delta Xw = A\sin(\omega b \cdot t + \phi 1 + D)$$

where A is position variation amplitude and D is the phase difference from the reference position of the intermediate transfer belt 7 to the image formation start of the registration pattern. Position variation ΔXr at the image read time can be represented as $$\Delta Xr = A\sin(\omega b \cdot t + \phi 1 + D + Ly)$$

where Ly is the phase difference from registration pattern image formation to image read.

Detection data ΔXs, which is the position variation difference at the image formation time and the image read time as described above, becomes $$\begin{aligned}\Delta Xs &= \Delta Xw - \Delta Xr \\ &= A\sin(\omega b \cdot t + \phi 1 + D) - A\sin(\omega b \cdot t + \phi 1 + D + Ly) \\ &= 2A\sin(-Ly/2)\cos(\omega b \cdot t + \phi 1 + D + Ly/2) \\ &= 2A\sin(Ly/2)\sin(\omega b \cdot t + \phi 1 + D + Ly/2 + 3/2\pi)\end{aligned}$$

Therefore, the position variation indicated from the reference position by the intermediate transfer belt 7 becomes a waveform with amplitude shifted $1/\{2\sin(Ly/2)\}$ times that of the detection data ΔXs and phase shifted $(D+Ly/2+3/2\pi)$ rad.

Therefore, using $$\Delta Xs = B\sin(\omega b + \omega 2)$$

for the actual data provided in the read section, position shift ΔX occurring on the intermediate transfer belt 7 from one reference position is found as $$\Delta X = B \times 1/\{2\sin(Ly/2)\} X \sin\{\omega b \cdot t + \omega 2 - (D + Ly/2 + 3/2\pi)\}$$

As a specific example, setting round length of intermediate transfer belt 7, L=1922 (mm);

distance between reference position and image formation position Y, D=319.7 (mm); and distance between image formation position Y and read section, Ly=687.5 (mm), and using $$\Delta Xs = 0.1\sin(\omega b \cdot t + \omega 2)$$

for detection data amplitude=100 (μm), namely, detection data, the position variation ΔX at the reference position of the intermediate transfer belt 7 becomes $$\begin{aligned}\Delta X &= 0.1 \times 1/\{2 \times \sin(687.5/1922 \times 2\pi/2)\} \times \sin(\omega b \cdot t + \\ &\quad \phi 2 - 319.7/1922 \times 2\pi + 687.5/1922 \times 2\pi/2 + 3/2\pi) \\ &= 0.054 \times \sin(\omega b \cdot t + \phi 2 - 6.8)\end{aligned}$$

Figure 10:
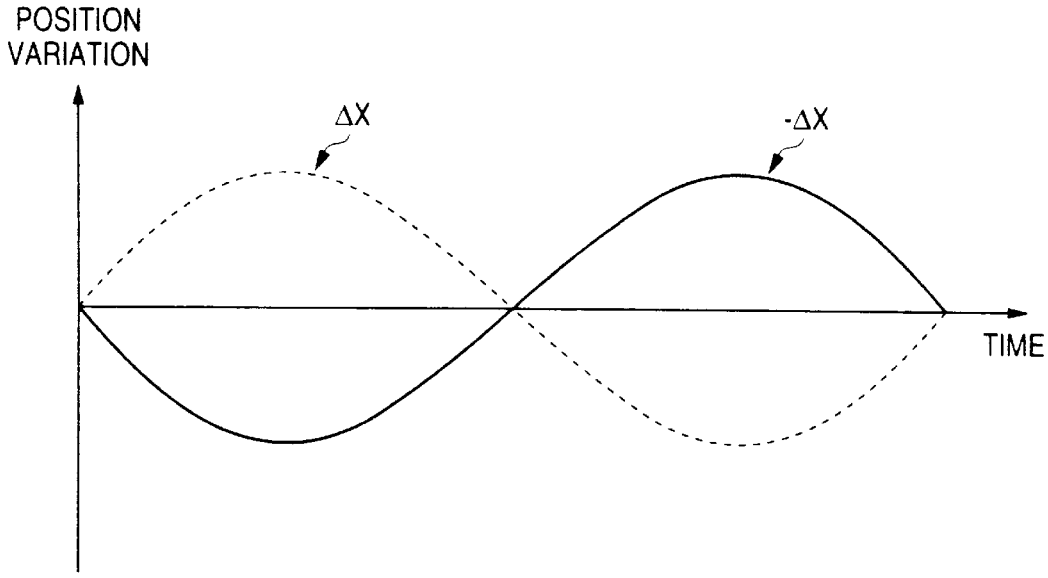
FIG. 10 is an illustration of one example of a control signal for correcting position variation (No. 1)

The position variation data thus found is stored in storage means, for example. At the actual image formation time, control is performed to correct such position variation in accordance with the stored position variation data, whereby an image with no color shift or inconsistencies in density can be provided. For the control correcting the position variation, the drive motor for driving the drive roll 8 may be controlled, for example. FIG. 10 is an illustration of one example of a control signal for correcting position variation. Specifically, if such an opposite-phase signal canceling calculated position variation data as indicated by a dashed line in FIG. 10, such as a position signal indicated by a solid line in the figure, is added to a drive motor position command signal and control is performed, the process AC position shift caused by the thickness unevenness of the intermediate transfer belt 7 can be reduced.

In addition, for example, the position variation data in each image formation section is found by changing the phase of the position variation data found as described above and the write position into the photosensitive body 3 by an image write section 2 may be controlled in accordance with the position variation data.

In the example, the effect of the thickness unevenness of the intermediate transfer belt 7 is sensed as image formation position variation and is corrected. However, speed variation caused by the thickness unevenness of the intermediate transfer belt 7 can also be sensed for correction. In this case, speed variation ΔVn is sensed in the following sequence: First, for the registration pattern 23 as shown in FIGS. 5A and 5B, the speed variation ΔVn can be found as $$\Delta Vn = V = \Sigma^{n} \tfrac{1}{2}(tn_{side2} + tn_{side1})$$

$$[M = \Sigma^{N} \tfrac{1}{2}(tn_{side2} + tn_{side1})/N]$$

For the registration pattern 23 as shown in FIGS. 6A and 6B, the speed variation Vn can be found as $$\Delta Vn = V \times \Sigma^{n}(tn)M$$

$$[M = \Sigma^{N}(tn)/N]$$

To use another pattern as the registration pattern 23, the speed variation may be calculated in response to the pattern used. Since the sense result contains other speed variation components, averaging processing is performed in a similar manner to that described above and only the effect of the thickness unevenness of the intermediate transfer belt 7 is extracted.

To remove the speed variation occurring at the read time of the registration pattern 23 finally, the following calculation is executed: Assume that speed variation ΔV indicated from a reference position by the intermediate transfer belt 7 is $$\Delta V = A \sin(\omega b \cdot t + \phi 3)$$

At this time, speed variation ΔVw at the image formation time of the registration pattern 23 can be represented as $$\Delta Vw = A \sin(\omega b \cdot t + \phi 3 + D)$$

where A is speed variation amplitude and D is the phase difference from the reference position of the intermediate transfer belt 7 to the image formation start of the registration pattern 23. Speed variation Vr at the image read time can be represented as $$\Delta Vr = A \sin(\omega b \cdot t + \phi 3 + D + Ly)$$

where Ly is the phase difference from the image formation position on the #1 photosensitive body 3 to the read section 21.

Detection data ΔVs, which is the speed variation difference at the image formation time and the image read time, becomes $$\begin{aligned}\Delta Vs &= \Delta Vw - \Delta Vr \\ &= A \sin(\omega b \cdot t + \phi 3 + D) - A \sin(\omega b \cdot t + \phi 3 + D + Ly) \\ &= 2A \sin(-Ly/2) \cos(\omega b \cdot t + \phi 3 + D + Ly/2) \\ &= 2A \sin(Ly/2) \sin(\omega b \cdot t + \phi 3 + D + Ly/2 + 3/2\pi)\end{aligned}$$

Therefore, the speed variation indicated from the reference position by the intermediate transfer belt 7 becomes a waveform with amplitude shifted 1/{2 sin (Ly/2)} times that of the detection data ΔVs and phase shifted (D+Ly/2+3/2π) rad.

Therefore, using $$\Delta Vs = C \sin(\omega b \cdot t + \phi 4)$$

for the detection data, speed variation ΔV at the reference position of the intermediate transfer belt 7 is found as $$\Delta V = C \times 1/\{2 \sin(Ly/2)\} X \sin\{\omega b \cdot t + \phi 4 - (D + Ly/2 + 3/2\pi)\}$$

Figure 11:
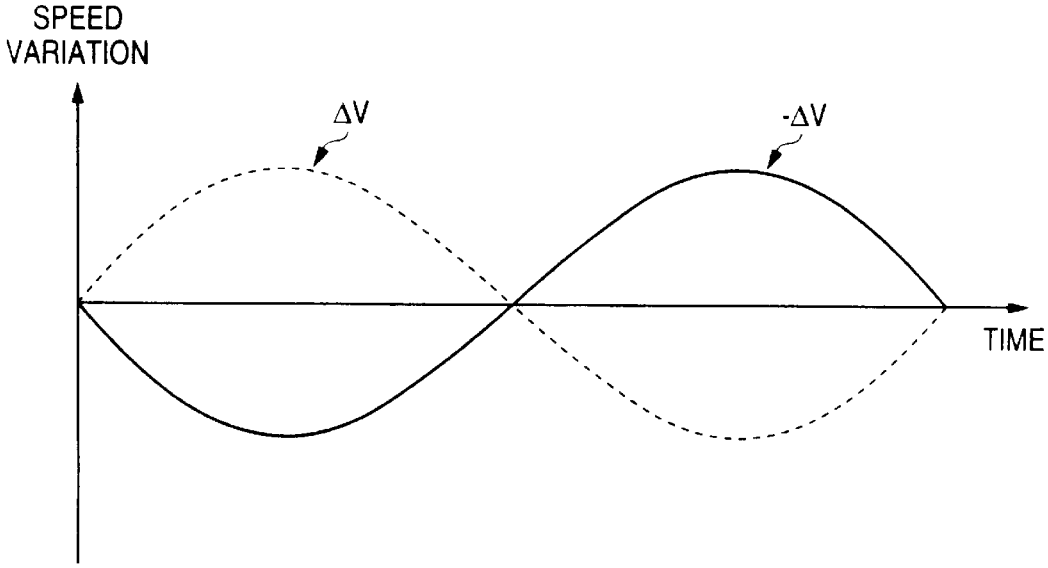
FIG. 11 is an illustration of one example of a control signal for correcting speed variation.

Such speed variation data is previously calculated before shipment or when the intermediate transfer belt 7 is replaced, for example. When actual image formation is executed, for example, if the angular velocity of the drive motor of the drive roll 8 is controlled or the image write section 2 of each image formation section is controlled based on the previously calculated speed variation data, an image with no color shift or inconsistencies in density can be provided. FIG. 11 is an illustration of one example of a control signal for correcting speed variation. For example, to control the drive motor of the drive roll 8, specifically if such an opposite-phase signal canceling calculated speed variation data as indicated by a dashed line in FIG. 11, such as a speed signal indicated by a solid line in the figure, is added to a drive motor speed command signal and control is performed, the speed variation caused by the thickness unevenness of the intermediate transfer belt 7 can be reduced and the image formation position variation can also be decreased.

Figure 12:
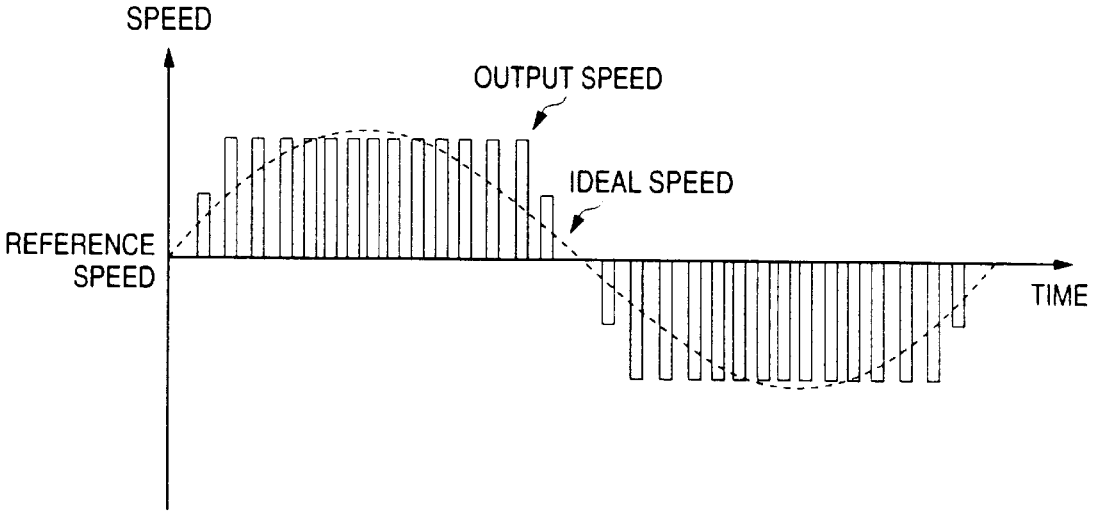
FIG. 12 is an illustration of examples of an ideal speed profile and an actual output speed profile.

FIG. 12 is an illustration of examples of an ideal speed profile and an actual output speed profile. As described above, the thickness unevenness of the intermediate transfer belt 7 is very low frequency variation as one cycle of the intermediate transfer belt 7. Thus, the image formation position variation caused by the effect is also very low frequency. Such low frequency variation indicates a large value as position variation, but the speed variation itself may often be minute. Therefore, for example, if a stepping motor is used as the drive motor and the angular velocity is controlled, the resolution of the rotation angle of the drive motor is insufficient and ideal speed control as indicated by a dashed line in FIG. 12 may be unable to be performed. In such a case, speed control may be performed step by step as indicated by a solid line in FIG. 12 for making a correction so that the areas on the graph, namely, positions become almost equal. In the example, speed control at two steps above and below the reference speed is performed.

Now, assume that the minimum resolution of ωd is $\omega d_{min}$ and that $\omega d = \omega d_{min} \cdot n$. Here, assume that n is an integer value. Control is performed every encoder pulse. Assuming that the number of the teeth of the encoder is Enc, the control unit time is $$\begin{aligned}\text{drum cycle}/Enc\ \text{count} &= 2\pi/\omega d/Enc \\ &= 2\pi/(\omega d_{\min} \cdot n)/Enc\end{aligned}$$

If change of minute amount β is assigned to controlled variable n and stepwise control is performed as shown in FIG. 12 so that position variation matches $\omega d=\omega d_{min}\cdot(n+\beta)$, the position shift amount per unit time is $$\text{unit time X speed change amount}=(2\pi/(\omega d_{min}\cdot n)/\text{Enc})\times(\omega d_{min}\cdot\beta\cdot r)=2\pi\cdot\beta\cdot/n/\text{Enc}$$

because $n>\beta$.

At the nth control timing, the assumed position shift accumulation amount by the nth control becomes $$\Sigma_{(k=0)}^{(n-1)}(2\pi\cdot\beta k\cdot r/n/\text{Enc})$$

Let the position shift amount to be controlled be $\Delta x(n)$. Minimum $\beta n$ satisfying $$-\tfrac{1}{2}\times 2\pi\cdot\beta n\cdot r/n/\text{Enc}\leqq\Delta x(n)-\Sigma_{(k=0)}^{(n-1)}(2\pi\cdot\beta k\cdot r/n/\text{Enc})\leqq\tfrac{1}{2}\times 2\pi\cdot\beta n\cdot r/n/\text{Enc}$$

is and control may be performed. Such control is performed, whereby the drive motor is controlled according to the output speed as indicated by the solid line in FIG. 12. Also shown in FIG. 12, if the speed variation is small, a correction is made according to a small controlled variable; if the speed variation is large, a correction is made according to a large controlled variable and the control frequency of the large controlled variable increases in response to the magnitude of the speed variation.

Figure 13A:
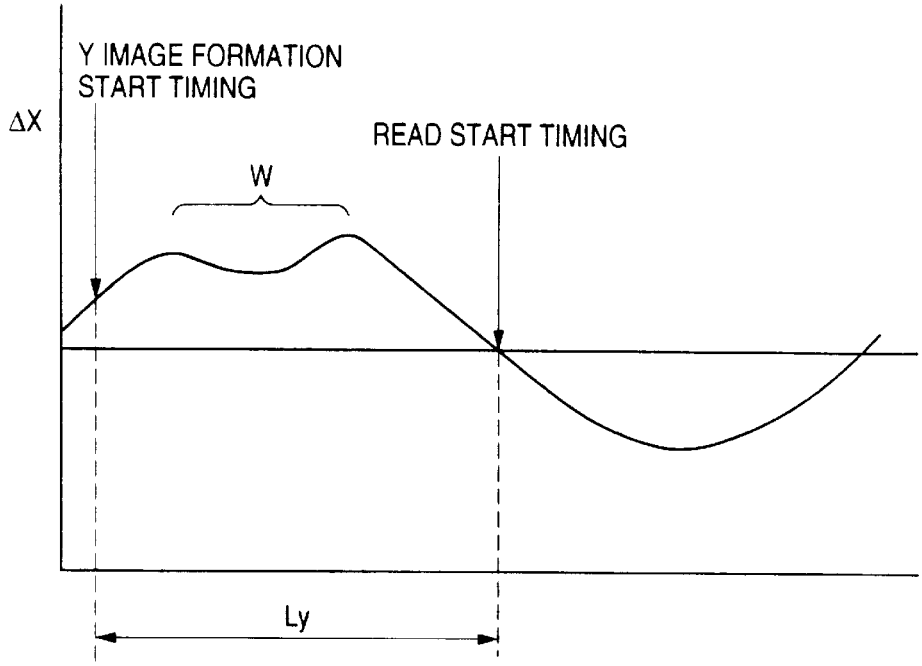
FIGS. 13A and 13B are illustrations of the relationship between actual measurement sense data and position variation (No. 2)

By the way, if the position variation (or speed variation) caused by the thickness unevenness of the intermediate transfer belt 7 is a primary sinusoidal waveform (known quadratic or more trigonometric function), position variation data is calculated according to the above-described algorithm and control is performed based on the calculated data, whereby an image with no color shift or inconsistencies in density can be provided. However, for example, if a part where the thickness changes largely occurs at the manufacturing stage of the intermediate transfer belt 7, the waveform of position variation caused by thickness unevenness of the belt becomes a complicated waveform (unknown) having a cycle in one cycle (round) of the belt. In such a case, if the waveform is assumed to be a primary sine wave and position variation data is found, for example, for a variation waveform as shown in FIG. 13A, a detection error occurs in waveform part W not matching a sine wave. Then, in such a case, true position variation data is found according to the following procedure:

First, assume that the round length of the intermediate transfer belt 7 is L and that the distance between the Y image formation position and the read section is Ly (see FIG. 13A), and L and Ly are divided by one numeral d (length). In doing so, definition can be made like $L=n\times d$ and $Ly=m\times d$. Here, preferably the value of d is an integer such that m and n are integers and are relatively prime for the reason described later.

Figure 13B:
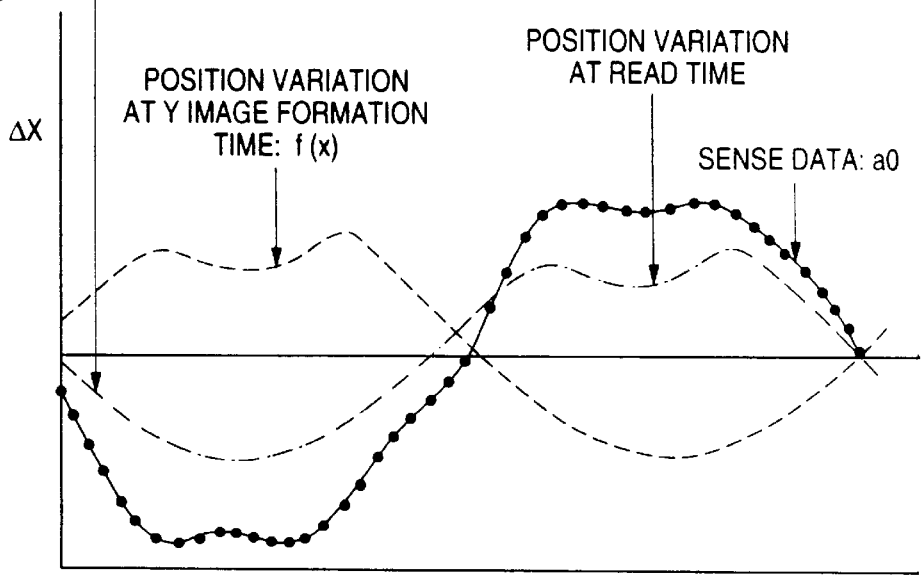

Using f (x) as shown in FIG. 13B for the position variation data at the Y image formation point to be found (true position variation data), composite wave data actually sensed in the read section can be defined as $f(x)-f(x+Fy\times 2\pi\div L)$ where f (x) is a periodic function having periodicity in one cycle (round) of the belt and can be set arbitrarily.

Now, as a specific example, assuming that round length of intermediate transfer belt 7, L=2000 (mm);

distance between Y image formation position and read section, Ly=700 (mm); and division length d=100 (mm), m=20 and n=7, thus $L=20\times d$ and $Ly=7\times d$.

The above-described composite wave data is represented as $f(x)-f(x+7d\times 2\pi\div L)$.

At this time, the composite wave data, $f(x)-f(x+7d\times 2\pi\div L)$, corresponds to actual sense data a0 (see FIG. 13B), thus the sense data a0 is shifted in phase by d a total of 19 (20−1) times, thereby preparing data (a1–a19) as follows:

a0: $f(x)-f(x+7d\times 2\pi\div L)$ as sense data
a1: $f(x+d\times 2\pi\div L)-f(x+8d\times 2\pi\div L)$
a2: $f(x+2d\times 2\pi\div L)-f(x+9d\times 2\pi\div L)$
a3: $f(x+3d\times 2\pi\div L)-f(x+10d\times 2\pi\div L)$
a4: $f(x+4d\times 2\pi\div L)-f(x+11d\times 2\pi\div L)$
a5: $f(x+5d\times 2\pi\div L)-f(x+12d\times 2\pi\div L)$
a6: $f(x+6d\times 2\pi\div L)-f(x+13d\times 2\pi\div L)$
a7: $f(x+7d\times 2\pi\div L)-f(x+14d\times 2\pi\div L)$
a8: $f(x+8d\times 2\pi\div L)-f(x+15d\times 2\pi\div L)$
a9: $f(x+9d\times 2\pi\div L)-f(x+16d\times 2\pi\div L)$
a10: $f(x+10d\times 2\pi\div L)-f(x+17d\times 2\pi\div L)$
a11: $f(x+11d\times 2\pi\div L)-f(x+18d\times 2\pi\div L)$
a12: $f(x+12d\times 2\pi\div L)-f(x+19d\times 2\pi\div L)$
a13: $f(x+13d\times 2\pi\div L)-f(x+20d\times 2\pi\div L)$
a14: $f(x+14d\times 2\pi\div L)-f(x+21d\times 2\pi\div L)$
a15: $f(x+15d\times 2\pi\div L)-f(x+22d\times 2\pi\div L)$
a16: $f(x+16d\times 2\pi\div L)-f(x+23d\times 2\pi\div L)$
a17: $f(x+17d\times 2\pi\div L)-f(x+24d\times 2\pi\div L)$
a18: $f(x+18d\times 2\pi\div L)-f(x+25d\times 2\pi\div L)$
a19: $f(x+19d\times 2\pi\div L)-f(x+26d\times 2\pi\div L)$ Here, focusing attention on the a13 data, the latter part, $f(x+20d\times 2\pi\div L)$, is shifted in phase just one cycle (20d) relative to f (x), namely, $f(x+20d\times 2\pi\div L)=f(x)$. This relation also applies to the latter parts of the data pieces a14–a19 as follows:

$f(x+21d\times 2\pi\div L)=f(x+d\times 2\pi\div L)$
$f(x+22d\times 2\pi\div L)=f(x+2d\times 2\pi\div L)$
$f(x+23d\times 2\pi\div L)=f(x+3d\times 2\pi\div L)$
$f(x+24d\times 2\pi\div L)=f(x+4d\times 2\pi\div L)$
$f(x+25d\times 2\pi\div L)=f(x+5d\times 2\pi\div L)$
$f(x+26d\times 2\pi\div L)=f(x+6d\times 2\pi\div L)$ Therefore, the data pieces a13–a19 are represented as follows:

a13: $f(x+13d\times 2\pi\div L)-f(x)$
a14: $f(x+14d\times 2\pi\div L)-f(x+d\times 2\pi\div L)$
a15: $f(x+15d\times 2\pi\div L)-f(x+2d\times 2\pi\div L)$
a16: $f(x+16d\times 2\pi\div L)-f(x+3d\times 2\pi\div L)$
a17: $f(x+17d\times 2\pi\div L)-f(x+4d\times 2\pi\div L)$
a18: $f(x+18d\times 2\pi\div L)-f(x+5d\times 2\pi\div L)$
a19: $f(x+19d\times 2\pi\div L)-f(x+6d\times 2\pi\div L)$ When the data pieces a0–a19 are thus found, the following calculations [0]–[19] are executed for the found data:

[0] $a0$

[1] $a0+a7$

[2] $a0+a7+a14$

[3] $a0+a7+a14+a1$

⋮

[19] $a0+a7+a17+a1+a8+a15+a2+a9+a16+a3+a10+a17+a4+a11+a18+a5+a12+a19+a6+a13$

For example, in the calculation expression [2], the term $-f(x+7d\times 2\pi\div L)$ in a0 and the term $f(x+7d\times 2\pi\div L)$ in a7 and the term −f (x+14d×2π÷L) in a7 and the term f (x+14d×2π÷L) in a14 have positive and negative relation and negate each other. That is, the common terms having positive and negative relation negate each other in each calculation expression and resultantly, the calculation expressions [0]–[19] are represented as follows:

$$[0]\quad f(x)-f(x+7d\times 2\pi\div L)$$

$$[1]\quad f(x)-f(x+14d\times 2\pi\div L)$$

$$[2]\quad f(x)-f(x+d\times 2\pi\div L)$$

$$[3]\quad f(x)-f(x+8d\times 2\pi\div L)$$

$$\vdots$$

Then, the calculation expressions [0]–[19] are added together.

$$f(x)\times 20-\{f(x)+d\times 2\pi\div L)+f(x)+2d\times 2\pi\div L)+f(x)+3d\times 2\pi\div L)+\ldots+f(x)+19d\times 2\pi\div L)\}$$

Here, the part {f (x)+d×2π÷L)+f (x)+2d×2π÷L)+f (x)+3d×2π÷L)+. . . +f (x)+19d×2 L)} is provided by shifting the periodic function f (x) in phase by d and adding one cycle (positive and negative) and theoretically becomes zero.

Therefore, the true position variation data, f (x), can be found by dividing the addition expression of [0]–[19] by 20.

The calculation processing performed so far is represented by the following general expression:

$$f(x)=[\{\Sigma_{(i=1)}{}^{(n-1)}f(x+i\times m\times d\times 2\pi\div L)-f(x+(i+1)\times m\times d\times 2\pi\div L)\}\times(n-1)]\div n$$

Figure 14:
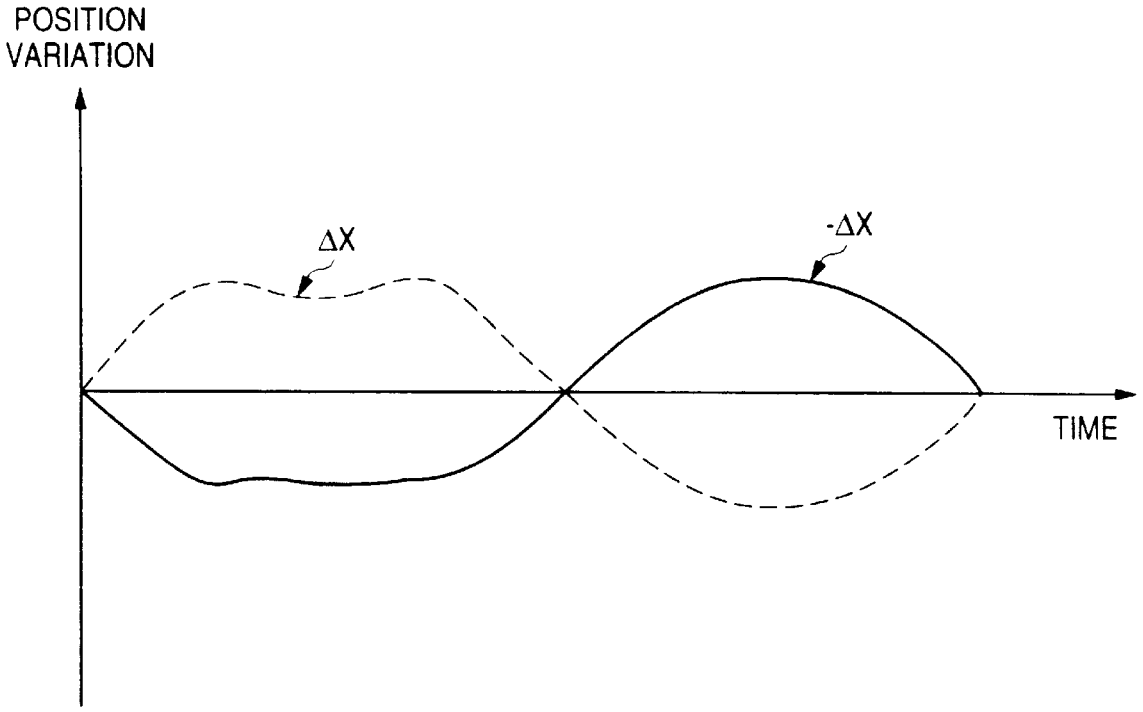
FIG. 14 is an illustration of one example of a control signal for correcting position variation (No. 2)

The true position variation data f (x) corresponding to the sense data a0 is found based on the general expression, then is stored in storage means, etc. At the actual image formation time, control is performed to correct position variation in accordance with the previously stored position variation data, whereby if the waveform of position variation caused by thickness unevenness of the belt becomes a complicated waveform (unknown) having a cycle in one cycle (round) of the belt, the true position variation data can be found accurately. FIG. 14 is an illustration of one example of a control signal for correcting such position variation.

Also in this case, such an opposite-phase signal canceling position variation ΔX as indicated by a dashed line in FIG. 14, such as a position signal (−ΔX) indicated by a solid line in the figure, is added to a drive motor position command signal and control is performed, whereby no matter how complicated the position variation waveform becomes, the process AC position shift caused by the thickness unevenness of the intermediate transfer belt 7 can be corrected with high accuracy.

The above-described division length d becomes resolution when f (x) is found. It is set to an appropriate value, whereby the true position variation data f (x) can be found with accuracy. However, if the value of d is set so that above-mentioned m and n are integers which do not become relatively prime, when the common terms having positive and negative relation are eliminated as described above, a calculation expression with all terms eliminated results. In this case, if n calculation expressions hold, the remaining number of expressions becomes less than n and the resolution is degraded as much as the calculation expressions with all terms eliminated. In contrast, if the value of d (integer) is set so that m and n are integers which become relatively prime as in the embodiment, the n calculation expressions remain intact although the common terms having positive and negative relation are eliminated as described above. Thus, the true position variation data f (x) can be found without degrading the resolution of d.

We have discussed formation of the registration pattern 23 using the #1 photosensitive body 3 in the examples given above; if the registration pattern 23 is formed using any other photosensitive body 3, a color shift, inconsistencies in density, etc., can also be removed in a similar manner. However, to improve the detection accuracy, preferably a pattern formed using a photosensitive body 3 as distant as possible in the range not exceeding a half length of the intermediate transfer belt 7 from the read position is detected, in which case read data can be detected with a larger amplitude as described above. That is, in the configuration shown in FIG. 1, the Y (yellow) pattern formed using the #1 photosensitive body 3 can be detected with better accuracy and a larger amplitude as compared with other three photosensitive bodies 3.

To detect read data with the maximum amplitude, the read section 21 may be placed at a position such that the distance between the image formation position and the read position becomes a half of the round (cycle) length of the intermediate transfer belt 7, namely, a half phase of the cycle of the intermediate transfer belt 7. In doing so, the read data can be detected with amplitude twice that of actual write or read position variation. Further, in such placement, for position variation data and speed variation data provided in the read section 21, position variation data and speed variation data at the reference position can be provided simply by halving the amplitude and matching the phase. In this case, if position variation or speed variation synchronous with a position shift caused by thickness unevenness of the intermediate transfer belt 7 exists, the position variation data and speed variation data at the reference position containing the position variation and speed variation can also be prepared for control.

Figure 15:
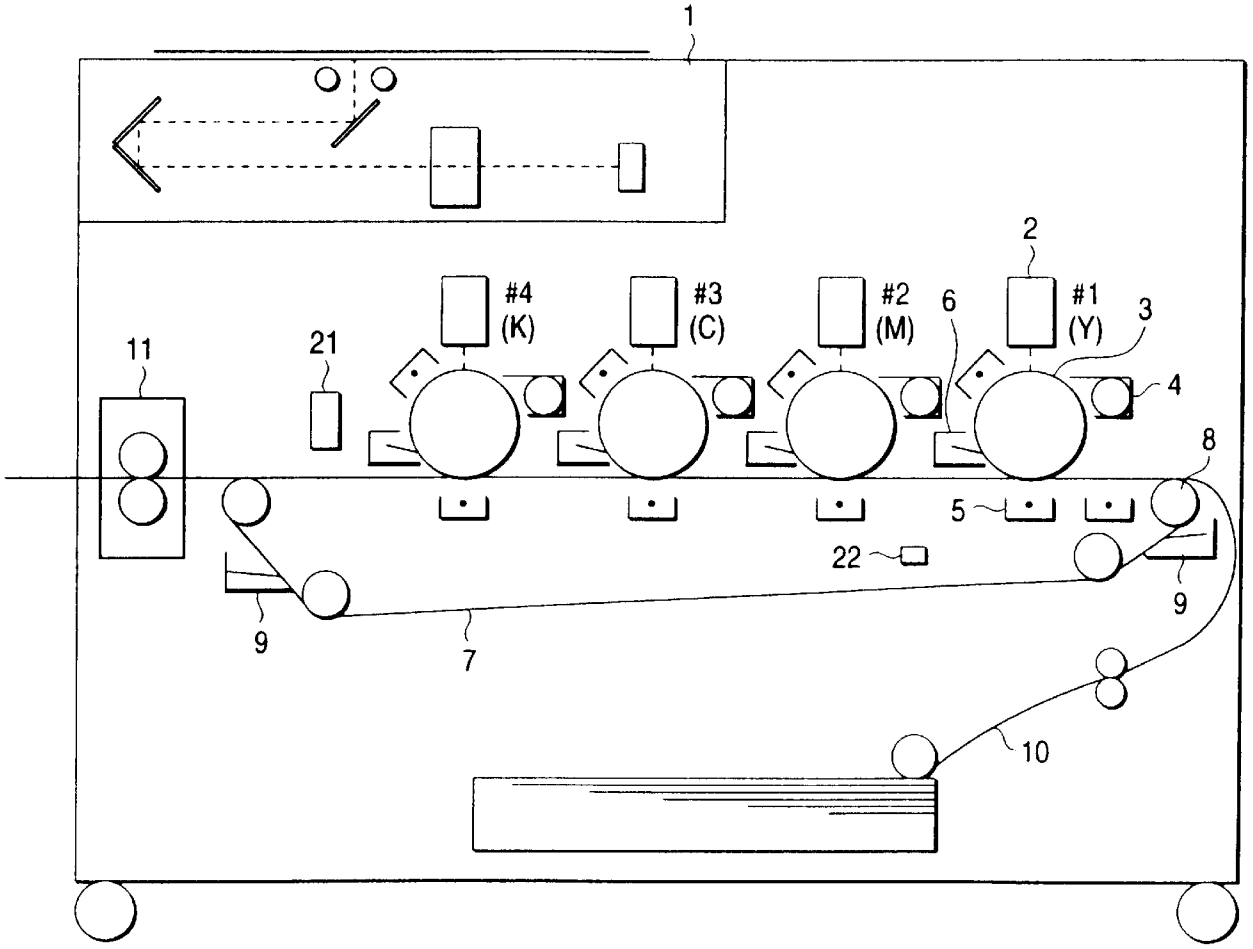
FIG. 15 is a schematic block diagram to show another embodiment of an image formation system of the invention.

FIG. 15 is a schematic block diagram to show another embodiment of an image formation system of the invention.

Parts similar to those previously described with reference to FIG. 1 are denoted by the same reference numerals in FIG. 15. Numeral 31 is a belt. In the embodiment, an image is formed from a photosensitive body 3 directly to paper 10 without using any intermediate transfer body. In the system of the configuration, paper 10 is transported on the belt 31 and the transport position or transport speed of the paper 10 varies due to thickness unevenness of the belt 31, causing a color shift and inconsistencies in density to occur as in the above-described configuration. Thus, the intermediate transfer belt 7 is considered to be the belt 31 and the above-described process is simply executed, whereby variation in the transport position or transport speed of the paper 10 caused by the thickness unevenness of the belt 31 can be corrected and an image of high image quality with no color shift or inconsistencies in density can be provided.

The above-described processing of forming the registration pattern 23, reading the pattern, and getting position or speed variation data may be performed before shipment or when the belt 31 is replaced. At this time, the registration pattern 23 can also be formed directly on the belt 31 and be read through a read section 21 for removing the effect of the paper 10. Of course, the paper 10 may be used.

In the configuration shown in FIG. 15, the belt 31 often is formed of a material easily transmitting light. In this case, the read section 21 can use a transmission-type photo receptor, for example.

In addition to the image formation systems, the invention can be applied to various image formation systems using a belt. For example, as described in Japanese Patent Laid-Open No. Hei 6-225096, an image formation system using no intermediate transfer body is also available which uses a photosensitive belt similar to the intermediate transfer belt 7 shown in FIG. 1 as photosensitive body 3, forms latent images directly on the photosensitive belt by image writers 2 of different colors, and develop images directly on the photosensitive belt by a developing machine for forming images of a plurality of colors on the photosensitive belt, then transfers the images to paper in batch to form a final image. Also in the image formation system, the formation positions of images of colors on the photosensitive belt vary due to thickness unevenness of the photosensitive belt, causing a color shift and inconsistencies in density to occur. However, the invention is applied to the image formation system and the above-described process is executed, whereby variation in the image formation position caused by the thickness unevenness of the photosensitive belt can be corrected and an image of high image quality with no color shift or inconsistencies in density can be provided.

The description given above assumes that the image formation start positions of the image formation sections are registered precisely. As the technique, the registration control technique described in Japanese Patent Laid-Open No. Hei 6-253151 can be applied. In the technique described here, image formation sections read marks formed on a belt, whereby the image formation start positions of the image formation sections are controlled. Both the pattern at this time and the registration pattern 23 used in the invention are used and from the pattern read timing in the read section 21, the thickness unevenness of the belt can be corrected according to the invention and the image formation start positions can also be corrected. Higher-quality images can be provided by fusing both the techniques.

Figure 22:
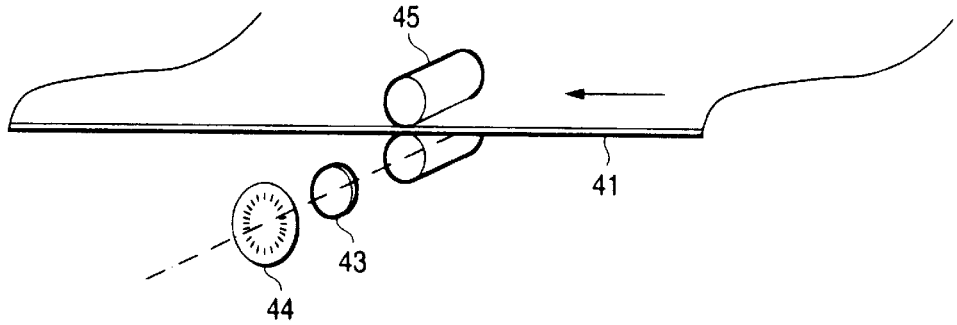
FIG. 22 RELATED ART
FIG. 22 is an illustration of another example of conventional speed variation sense means.
Figure 23:
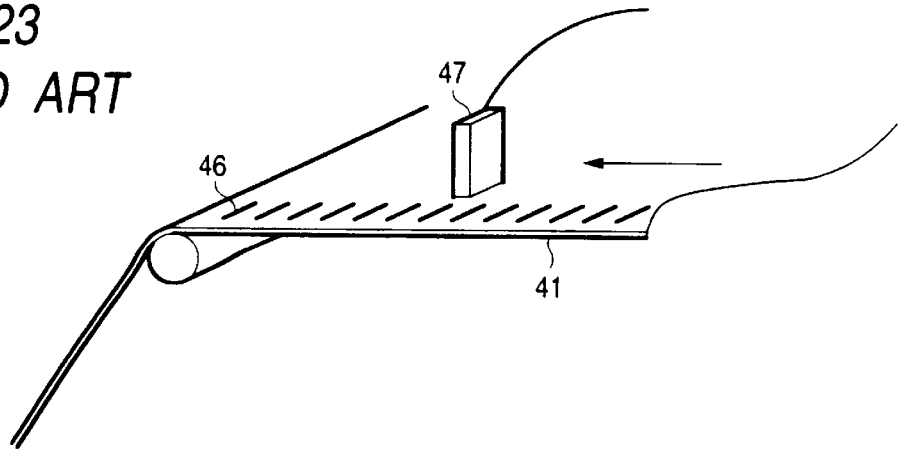
FIG. 23 RELATED ART
FIG. 23 is an illustration of another example of conventional speed variation sense means.

In the embodiments, the belt is driven by the drive roll 8, but the belt drive means is not limited to the drive roll 8. For example, a belt may be sandwiched between pinch rolls and driven, as shown in FIG. 22 or may be directly driven by a ultrasonic motor, a linear motor, etc., without using a roll. Even in the drive systems, image formation position variation occurs due to thickness unevenness of the belt, but can be corrected and an image of high image quality with no color shift or inconsistencies in density can be provided by applying the invention.

As seen from the description made so far, according to the invention, image formation position variation caused by thickness unevenness of the belt can be corrected and an image of high image quality with no color shift or inconsistencies in density can be provided. Since the manufacturing tolerance for the belt thickness need not strictly be managed, costs can be reduced.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image formation system comprising:

a belt;

means for driving said belt;

means for forming an image at a predetermined timing, said image formation means being placed facing said belt driven by said drive means, the image formation means also forming a registration pattern on the belt;

means for reading the image and the registration pattern formed by said image formation means; said image read means being disposed at a position different from the position of said image formation means; and means for sensing a position or speed variation amount of said belt driven by said drive means at least based on the registration pattern read by said image read means over a plurality of cycles of the belt and correcting a sense error resulting from a speed or position variation occurring between the registration pattern formation by the image formation means and the reading of the registration pattern by the image read means.

2. The image formation system as claimed in claim 1 wherein a plurality of image formation means are provided facing said belt and wherein said variation amount sensing and correcting means senses and corrects the variation amount based on an image formed using at least one of said plurality of image formation means and a distance between said image formation means forming the image and said image read means along said belt.

3. The image formation system as claimed in claim 2 wherein said image formation means for forming the image used by said variation amount sensing and correcting means is the image formation means at the longest distance from said image read means.

4. The image formation system as claimed in claim 1 wherein said image read means is placed at a position distant by a half length of said belt from said image formation means along said belt.

5. An image formation system comprising a belt, means of driving said belt, means for measuring cyclic variation when said belt is driven, and mean for sensing a position or speed variation amount of said belt caused by unevenness in thickness of said belt based on the cyclic variation amount of said belt measured by said cyclic variation measurement means and correcting an image formation position variation resulting from a speed or position variation of the belt occurring between an image formation on the belt and a reading of the image formed on the belt.

6. The image formation system as claimed in claim 5 wherein said cyclic variation measurement means gets position information of said belt in response to the cycle of said belt.

7. The image formation system as claimed in claim 5 wherein said variation amount sensing and correcting means extracts a low-frequency component from the belt position information in more than one cycle of said belt gotten by said cyclic variation measurement means as the belt position or speed variation amount caused by the unevenness in thickness of said belt.

8. The image formation system as claimed in claim 5 wherein said variation amount sensing and correcting means makes a phase difference correction based on a phase difference caused by a difference between a predetermined reference position and a measurement position of said cyclic variation measurement means for the belt position or speed variation amount caused by the unevenness in thickness of said belt and corrects as the belt position or speed variation amount caused by the unevenness in thickness of said belt at the reference position.

9. The image formation system as claimed in claim 5 further comprising drive control means for controlling drive speed of said drive means based on the position or speed variation amount sensed and corrected by said variation amount sensing and correcting means.

10. The image formation system as claimed in claim 5 further comprising means for controlling a move distance of said belt based on the position or speed variation amount sensed and corrected by said variation amount sensing and corrected means.

11. The image formation system as claimed in claim 5 further including image formation control means for controlling an image formation position based on the position or speed variation amount sensed and corrected by said variation amount sensing and correcting means.

12. A control method of an image formation system comprising a belt, means for driving said belt, means being placed facing said belt driven by said drive means for forming an image, means being disposed at a position different from the position of said image formation means for reading the image formed by said image formation means, and control means, said control method comprising the steps of driving said belt by said drive means, forming a pattern on said belt by said image formation means at a predetermined timing, reading the pattern by said image read means, measuring a time interval, sensing a position or speed variation amount of said belt based on the measured time interval, correcting an image formation position variation resulting from a speed or position variation of the belt occurring between the pattern formation on the belt and the reading of the pattern formed on the belt, and performing image formation control at the image formation time based on the sensed and corrected position or speed variation amount.

13. The image formation system control method as claimed in claim 12 wherein the image formation control at the image formation time is to control drive of said drive means based on the sensed and corrected position or speed variation amount.

14. The image formation system control method as claimed in claim 12 wherein the image formation control at the image formation time is to control image formation of said image formation means based on the sensed and corrected position or speed variation amount.

15. The image formation system control method as claimed in claim 12 wherein when the position or speed variation amount of said belt is sensed, a low-frequency component is extracted from time interval data measured by said image read means as long as a plurality of cycles of said belt, amplitude and phase are corrected, and the position or speed variation amount of said belt at a reference position is sensed.

* * * * *